US006226796B1

(12) United States Patent
Tollini

(10) Patent No.: US 6,226,796 B1
(45) Date of Patent: May 8, 2001

(54) FASTENER FOR SHIN GUARD

(76) Inventor: Michael D. Tollini, 9193 Beech Meadow Ct., Clarence, NY (US) 14032

( * ) Notice: Subject to any disclaimer, the term of this patent is extended or adjusted under 35 U.S.C. 154(b) by 0 days.

(21) Appl. No.: 09/544,255

(22) Filed: Apr. 5, 2000

Related U.S. Application Data

(60) Division of application No. 09/114,809, filed on Jul. 13, 1998, now Pat. No. 6,058,504, which is a continuation-in-part of application No. 09/019,228, filed on Feb. 5, 1998, now Pat. No. 5,920,901, which is a continuation-in-part of application No. 08/906,410, filed on Aug. 5, 1997.

(51) Int. Cl.[7] ..... A41D 13/06
(52) U.S. Cl. ..... 2/22; 2/22; 2/911
(58) Field of Search ..... 2/22, 24, 62, 338, 2/311, 220, 911, 16, 908, 910, 312, 221, 321–322, 326, 170, 171, 919, 920, 161.1; 602/23, 27, 65; 24/306, 442

(56) References Cited

U.S. PATENT DOCUMENTS

| | | | |
|---|---|---|---|
| 1,622,211 | | 3/1927 | Sheehan . |
| 2,817,841 | | 12/1957 | Bilecki . |
| 3,004,519 | | 10/1961 | Weissman . |
| 3,387,305 | | 6/1968 | Shafer . |
| 3,735,419 | | 5/1973 | Byrd . |
| 4,378,009 | | 3/1983 | Rowley et al. . |
| 4,497,070 | | 2/1985 | Cho . |
| 4,608,720 | | 9/1986 | Purin . |
| 4,627,109 | | 12/1986 | Carabelli et al. . |
| 4,700,406 | | 10/1987 | Meistrell . |
| 4,782,535 | | 11/1988 | Yewer et al. . |
| 4,805,606 | | 2/1989 | McDavid, III . |
| 4,836,194 | | 6/1989 | Sabastian et al. . |
| 4,843,651 | | 7/1989 | Gramza et al. . |
| 4,888,826 | | 12/1989 | Parsons, Jr. et al. . |
| 4,991,234 | | 2/1991 | Greenberg . |
| 5,016,621 | | 5/1991 | Bender . |
| 5,142,743 | | 9/1992 | Hahn . |
| 5,450,625 | | 9/1995 | Hu . |
| 5,537,689 | | 7/1996 | Dancyger . |
| 5,611,080 | | 3/1997 | Skottheim . |
| 5,628,063 | | 5/1997 | Reed . |
| 5,711,028 | | 1/1998 | Bourque et al. . |
| 5,742,945 | | 4/1998 | Lindaman . |
| 5,920,901 | * | 7/1999 | Tollini ..... 2/22 |
| 6,058,504 | * | 5/2000 | Tollini ..... 2/22 |

FOREIGN PATENT DOCUMENTS

| | | |
|---|---|---|
| 15750 | 12/1885 | (FR) . |
| 757414 | 9/1956 | (GB) . |

* cited by examiner

*Primary Examiner*—John J. Calvert
*Assistant Examiner*—Tejash Patel
(74) *Attorney, Agent, or Firm*—Joseph P. Gastel

(57) ABSTRACT

A fastener for a shin guard mounted on the leg of an athlete including upper and lower bands connected at their ends by diagonal bands, fork bands connecting the outer ends of the upper and lower bands to each other, a band of pile fabric extending outwardly from one of the fork bands, and a band of hook fabric extending outwardly from the other of the fork bands. A combined shin guard and fastener wherein the upper and lower bands are secured to the shin cover. A shin guard fastener consisting of an elongated flexible and resilient band having a central portion with a first attachment member for attaching the central portion to a sock or shin cover, and second and third attachment members on the end portions of the band for attaching the end portions to each other.

7 Claims, 18 Drawing Sheets

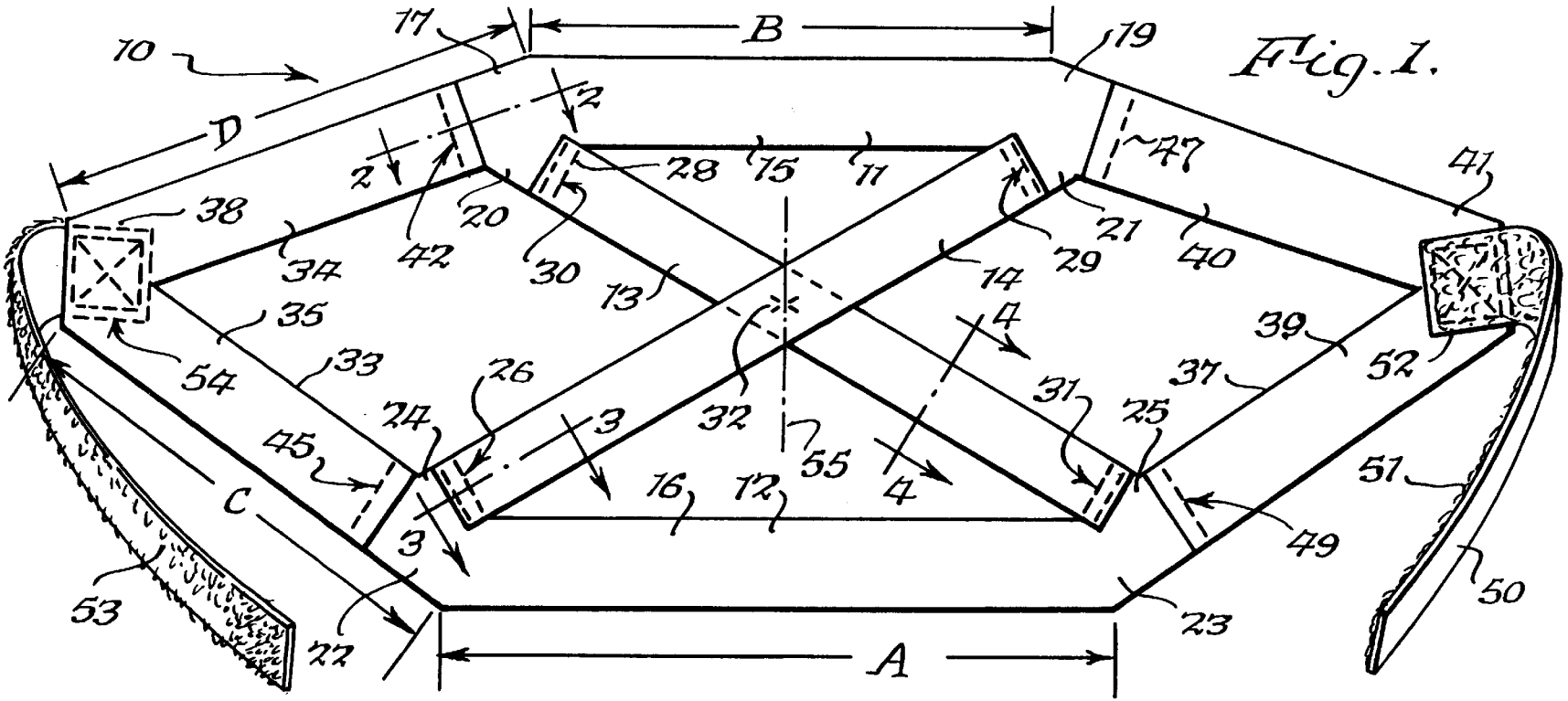
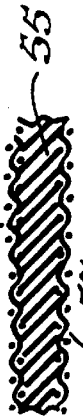
Fig. 4.
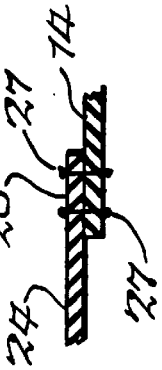
Fig. 3.
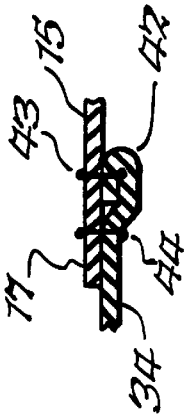
Fig. 2.

727
723
720
70
721
53
722
16
17
15
19
18
56
133
13
50
14
135
10
725
724
740
34
33
39
139
129
130
132
131
137

35
36
37
220
221
222
223
224
225
227
229
230
231
232
233
234
235
236
237
238

Fig. 38.
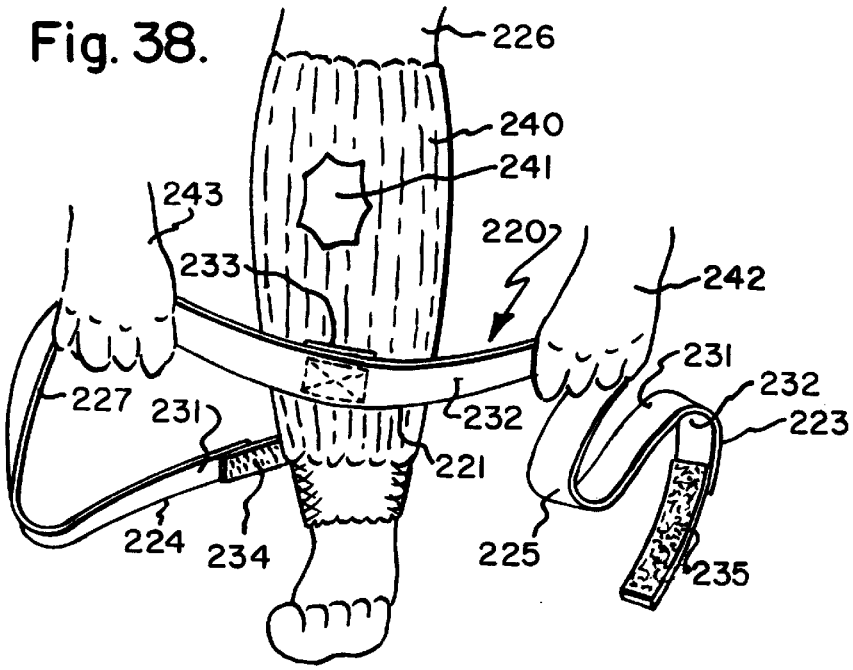
Fig. 39.
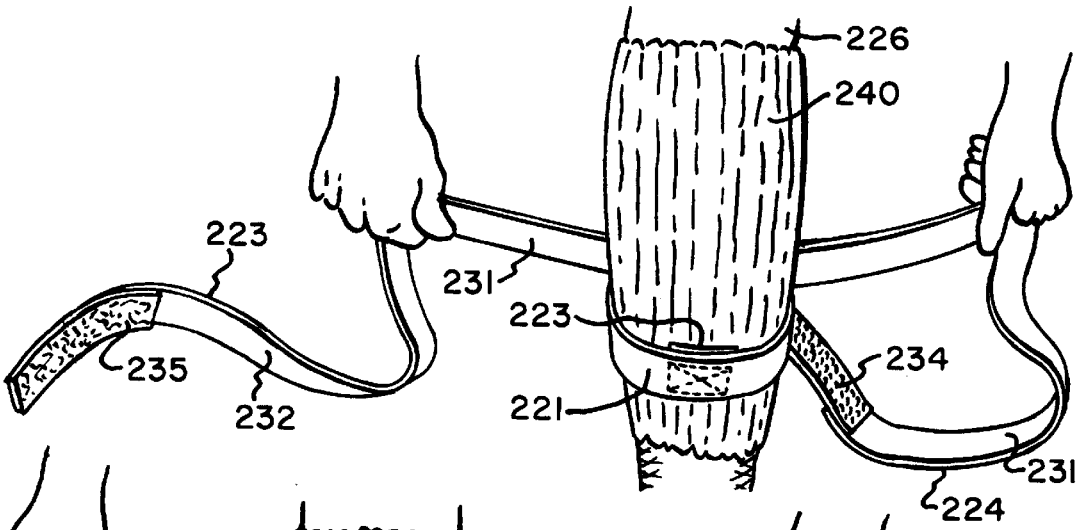
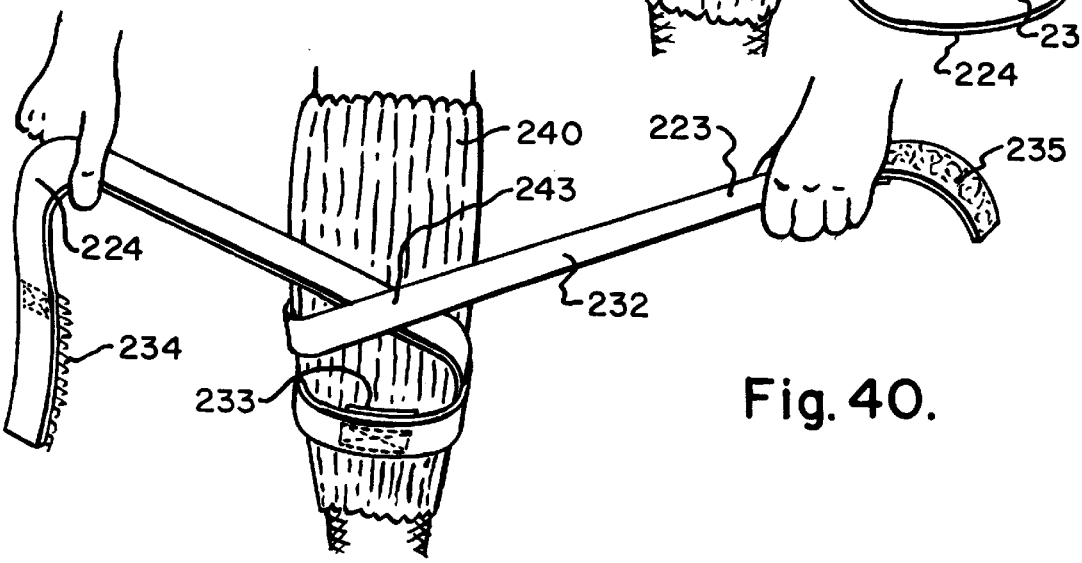
Fig. 40.

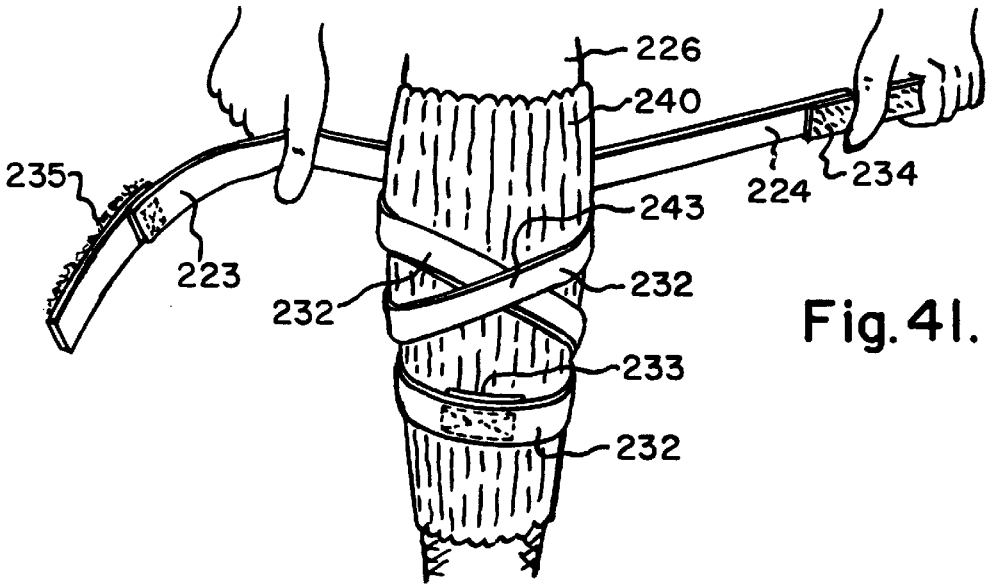
Fig. 41.
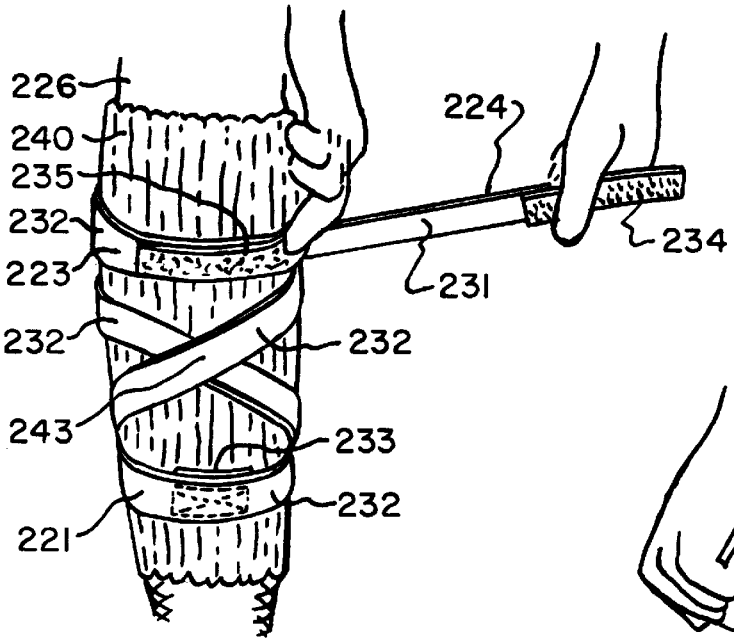
Fig. 42.
Fig. 43.
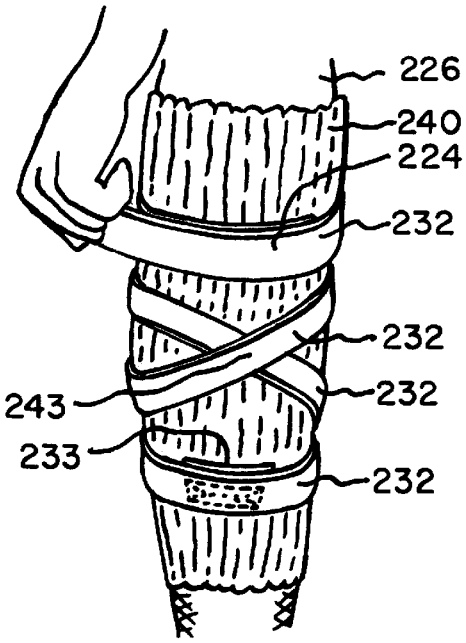

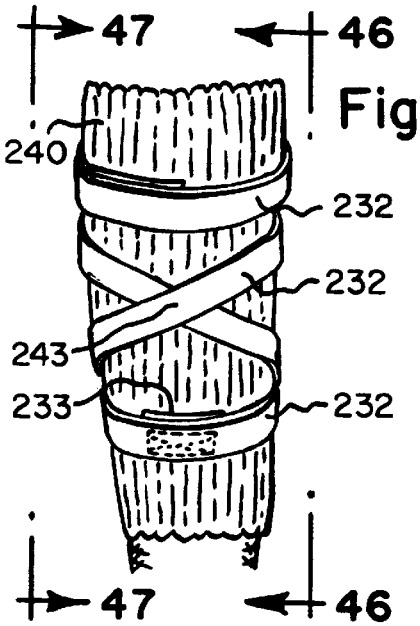
Fig. 44.
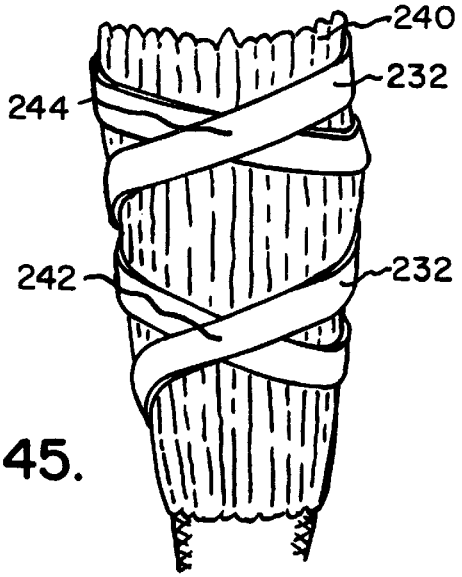
Fig. 45.
Fig. 46.
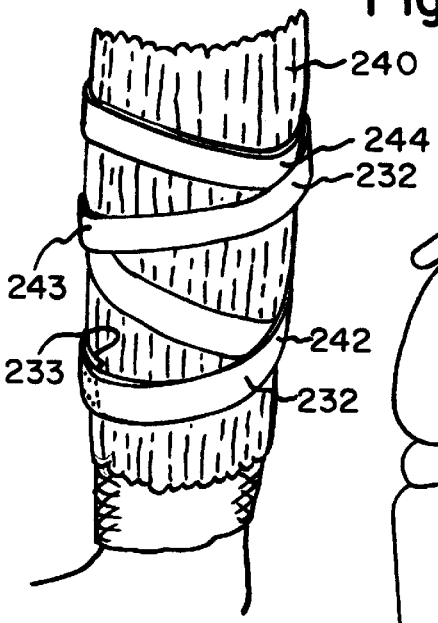
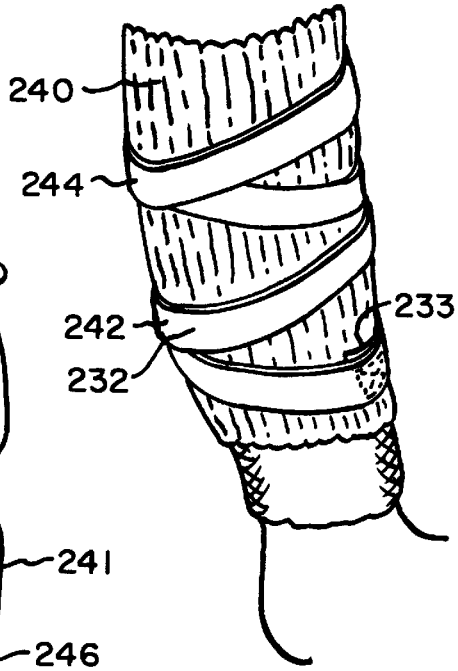
Fig. 47.
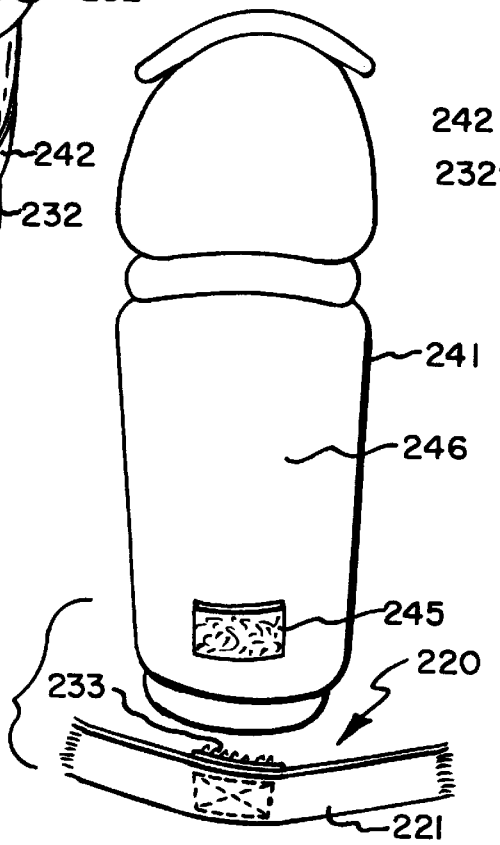
Fig. 48.

FASTENER FOR SHIN GUARD

CROSS-REFERENCE TO RELATED APPLICATIONS

The present application is a division of application Ser. No. 09/114,809, filed Jul. 13, 1998, which now U.S. Pat No. 6,058,504 is a continuation-in-part of application Ser. No. 09/019,228, filed Feb. 5, 1998 now U.S. Pat. No. 5,920,901 which is a continuation-in-part of application Ser. No. 08/906,410, filed Aug. 5, 1997.

STATEMENT REGARDING FEDERALLY SPONSORED

RESEARCH OR DEVELOPMENT

Not Applicable

BACKGROUND OF THE INVENTION

The present invention relates to an improved fastener for a shin guard and to an improved combined shin guard and fastener and to an improved shin guard which can selectively mount an improved fastener and to a shin guard fastener and sock combination.

By way of background, in sports such as hockey, shin guards are used to protect the shins of a player. The shin guards are usually mounted directly on the leg underneath a stocking. The shin guards are usually secured in position by means of upper and lower straps. This is usually insufficient to hold the shin guard in position. Accordingly, in the past there were numerous supplementary ways of holding the shin guard in position. One way was by binding the outside of the sock with adhesive tape. However, this was generally inadequate in that if the tape was wound too loosely, the shin guard was not held in position, and if it was wound too tightly, it could cut off circulation. Also in the past, elastic bands were used at the top and bottom of the shin guards. However, these bands, being stretchable, would permit the shin guard to move. Also, prior devices included an elongated sheet of elastic with vertical bands of hook and pile fabric at the edges of the sheet, and these were wound around the leg. However, the sheet would not conform to the leg and thus there was looseness in certain areas. It is with overcoming the foregoing deficiencies of the prior art that the present invention is concerned.

BRIEF SUMMARY OF THE INVENTION

It is accordingly one object of the present invention to provide an improved shin guard fastener which is in the form of an elongated band which can be mounted on the outside of a sock or can be attached to a shin guard underneath a sock.

It is another object of the present invention to provide an improved combined shin guard and fastener wherein the fastener provides multiple areas of contact longitudinally of the leg on the front of the shin guard and on the sides and on the rear of the leg.

A further object of the present invention is to provide an improved shin guard fastener and sock combination.

Yet another object of the present invention is to provide an improved shin guard fastener which provides multiple areas of contact on the front of the shin guard and on the sides and rear of the leg while requiring only a single area for fastening the shin guard. Other objects and attendant advantages of the present invention will readily be perceived hereafter.

The present invention relates to a shin guard fastener comprising an elongated band having a central portion and first and second end portions, a first attachment member on said first end portion, a second attachment member on said second end portion, and a third attachment member on said central portion.

The present invention also relates to a shin guard fastener and sock combination, comprising a sock, an elongated band having a central portion and outer end portions and intermediate portions between said central portion and said outer end portions, a first attachment member on said central portion secured to said sock, said intermediate portions extending diagonally about said sock, and second and third attachment members on said outer end portions.

The present invention also relates to a shin guard fastener and shin guard combination comprising a shin guard, an elongated band having a central portion and outer end portions and intermediate portions between said central portion and said outer end portions, said central portion lying across said shin guard, said intermediate portions extending diagonally relative to said shin guard, and first and second attachment members on said outer end portions.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 1 is a plan view of a fastener embodiment for securing a shin guard on a leg, with the view showing the outside surface thereof;

FIG. 2 is a fragmentary cross sectional view taken substantially along line 2—2 of FIG. 1 and showing the type of seam which is used at this junction;

FIG. 3 is a fragmentary cross sectional view taken substantially along line 3—3 of FIG. 1 and showing the lap type of seam used at this junction;

FIG. 4 is a fragmentary cross sectional view taken substantially along line 4—4 of FIG. 1 and showing the type of material which is used for all of the parts except for the attachment members on the outer end portions of the fastener;

FIG. 38 is a fragmentary front elevational view of the first step in mounting the improved shin guard fastener of FIGS. 30–37 onto a sock which overlies a shin guard;

FIG. 39 is a view similar to FIG. 38 but showing the improved shin guard fastener after the central portion thereof has been wound around the lower portion of the sock;

FIG. 40 is a view similar to FIG. 39 but showing the improved shin guard fastener after it has been further wound around the front of the sock;

FIG. 41 is a view similar to FIG. 40 but showing the improved shin guard fastener after it has been further wound around the rear of the sock;

FIG. 42 is a view similar to FIG. 41 but showing one of the end portions of the shin guard fasteners with the pile face thereon pressed against the upper portion of the sock;

FIG. 43 is view similar to FIG. 42 but showing the further step of attaching the hook attachment end of the shin guard fastener to the pile attachment end;

FIG. 44 is a front elevational view showing the improved shin guard fastener of FIGS. 30–37 fully installed on the outside of the sock;

FIG. 45 is a rear elevational view of the sock showing the orientation of the shin guard fastener thereon;

FIG. 46 is a fragmentary side elevational view taken substantially in the direction of arrows 46—46 of FIG. 44 and showing the configuration of the shin guard fastener on the side of the sock;

FIG. 47 is a fragmentary side elevational view taken substantially in the direction of arrows 47—47 of FIG. 44 and showing the orientation of the shin guard fastener on the side of the sock; and FIG. 48 is a front elevational view of a shin guard having an attachment member mounted on the lower end thereof for receiving a mating attachment member on the central portion of the improved shin guard fastener of FIGS. 30–37.

DETAILED DESCRIPTION OF THE INVENTION

Figure 5:
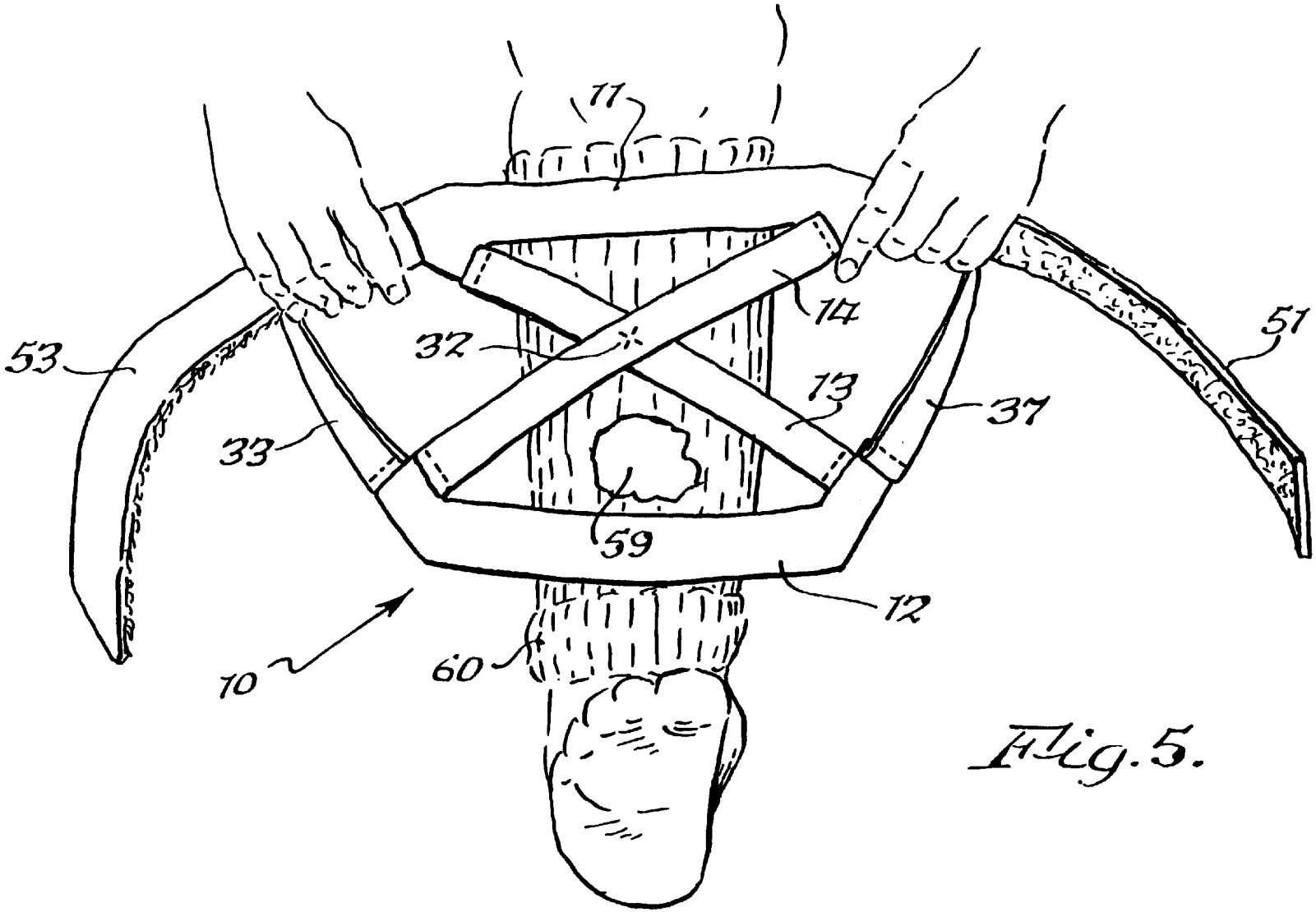
FIG. 5 is a fragmentary front elevational view showing the first step in mounting the fastener embodiment on a leg having a shin guard thereon.

The central portion of shin guard fastener 10 of the present invention includes an upper band structure 11, a lower band structure 12, and diagonal bands 13 and 14 effectively extending between upper band structure 11 and lower band structure 12. Upper band structure 11 includes a horizontal central band 15 having downwardly sloping ends 17 and 19 which are mirror image counterparts. Downwardly sloping ends 17 and 19 include tab portions 20 and 21, respectively. Lower band structure 12 includes a central horizontal band 16 and inclined ends 22 and 23 which are mirror image counterparts. Inclined end 22 includes a tab 24 and inclined end 23 includes a tab 25. The ends of diagonal band 14 are secured to tabs 21 and 24 by means of sewn lap joints 26 and 29. Lap joint 26 includes two rows of stitching 27, and lap joint 29 is the mirror image of lap joint 26. The outer ends of diagonal band 13 are sewn to tabs 20 and 25 by means of sewn lap joints 30 and 31, respectively. Lap joint 30 includes two rows of stitching 28, and lap joint 31 is essentially the mirror image of lap joint 30. Diagonal bands 13 and 14 are preferably threadably tacked to each other at their crossover area 32, but they need not be tacked. Also bands 13 and 14 can be sewn to each other in any suitable manner at their crossover area 32.

The upper band structure 11 of shin guard fastener 10 includes bands 34 and 40, and the lower band structure 12 includes bands 35 and 39. Bands 34 and 35 comprise a forked member 33 having a vertex 38. Bands 39 and 40 comprise a forked member having a vertex 41. Thus, the left end 17 of upper band 11 and the left end 22 of lower band 12 are connected to each other by a forked connecting member 33 having band portions 34 and 35 which are formed integrally at their vertex 38. The right end 19 of upper band 11 and the right end 23 of lower band 12 are connected to each other by forked connecting member 37 consisting of bands 39 and 40 which are integrally joined at vertex 41.

As can be seen from the above description, the upper band structure 11 and the lower band structure 12 are multiple band structures because they consist of a plurality of bands.

The diagonal bands 13 and 14 are also a multiple band structure in the form of an X.

FIG. 2 shows the joint 42, which is known as a sew seam reverse and topstitch joint, wherein the end 17 of band 15 is initially stitched to the end of band 34 by a row of stitching 43 when band 34 is laid on tab 17 and thereafter band 34 is turned 180° and tab 17 is stitched to band 34 by a row of stitching 44. Seam 45 is also a sew seam reverse and topstitch seam, and it is the mirror image of seam 42. Seam 47 is the mirror image of seam 42 and seam 49 is the mirror image of seam 45. A band 50 is stitched by means of a lap joint 52 to vertex 41 of member 37. Band 50 is an attachment band which has attachment means in the form of a pile surface 51 thereon. A band 53 is an attachment band having attachment means in the form of a hook surface 56. Attachment band 53 is attached to vertex 38 at a lap joint by stitching 54. Bands 50 and 53 preferably extend upwardly from the horizontal at approximate angles of 10°, but they need not extend upwardly at an angle.

The material from which all parts except attachment members 51 and 53 are made is stretchable and resilient, and it consists essentially of elastic neoprene foam core 55 bounded by knit fabric sides 57, and it is a commercial product of the Griswold Rubber Co. Thus, all parts except attachment members 50 and 53 are stretchable and resilient so as to conform to a leg about which they are wound.

By way of example and not of limitation a model has been made up having the following dimensions. Dimension A is 12 inches. Dimension B is 9 inches. Dimension C is 7½ inches, and dimension D is also 7½ inches. The fastener 10 is symmetrical about centerline 55.

FIGS. 5–9 are schematic representations of the steps used in mounting the shin guard fastener 10 onto a leg having a shin guard thereon, and FIGS. 9–12 show the fastener in fully mounted position. In these series of figures, the fastener 10 is schematically shown with only major portions thereof having numerals thereon.

In FIG. 5 the fastener 10 is shown in the initial position which it occupies with its upper band 11 against the upper portion of the shin and the lower band 12 against the lower portion of the shin. More specifically, the fastener 10 is shown as being used against the leg of a hockey player which mounts a shin guard 59 underneath a stocking 60. It will be appreciated that the shin guard 59 can be of any suitable type which is used in hockey, or if the fastener 10 is to be used with shin guards of other types, it can be visualized that shin guard 59 is the type used with such other sports.

Figure 6:
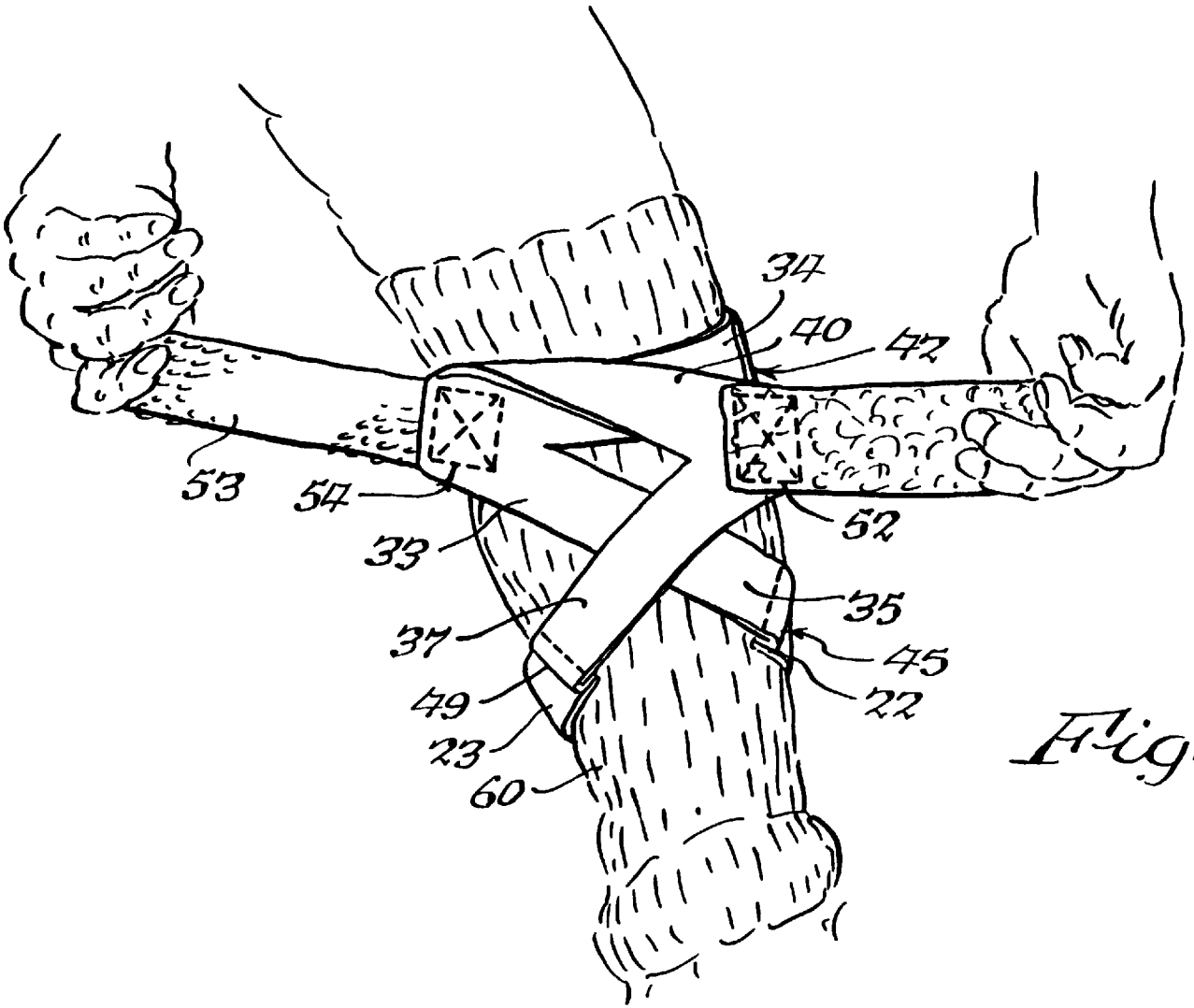
FIG. 6 is a rear elevational view of a leg with the fastener wrapped around the rear thereof during an initial stage of mounting the fastener on the leg.
Figure 7:
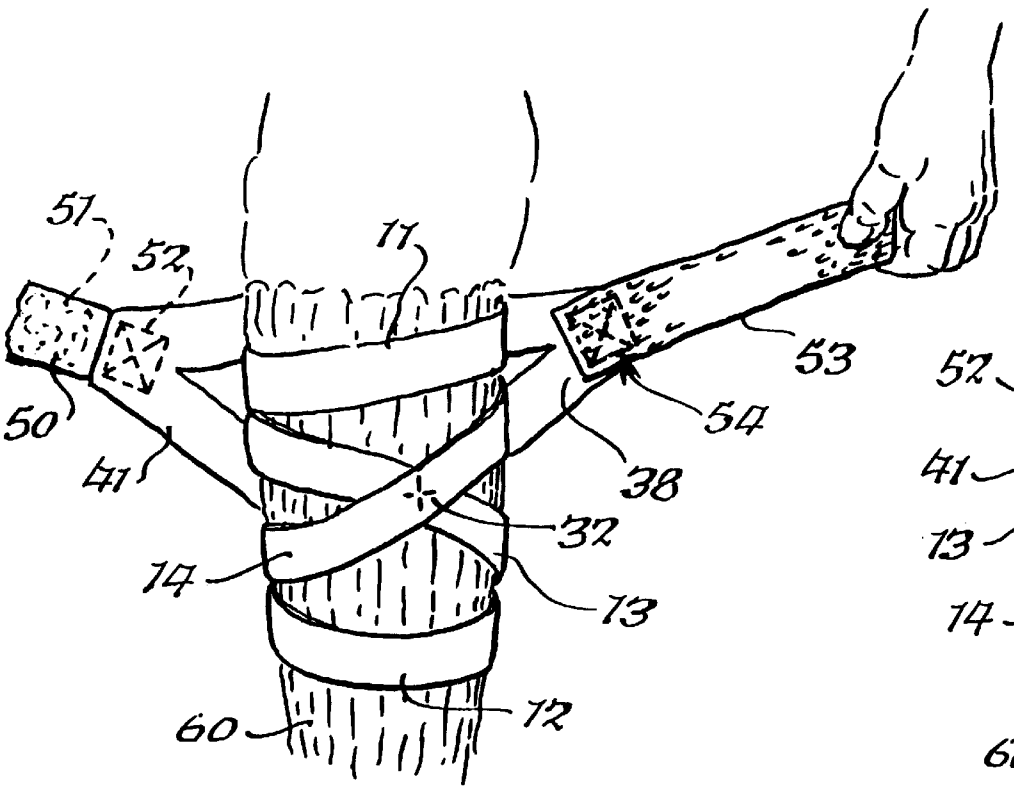
FIG. 7 is a front elevational view corresponding to the rear elevational view of FIG. 6.

In FIG. 6 a rear view of the leg is shown with the connecting member 33 threaded through the connecting member 37. At this time, the central portion of the shin guard 10 is pulled tightly against the front and sides of the leg. In FIG. 7 shin guard fastener 10 is shown on the front of the leg, and it corresponds to the position of the fastener 10 in FIG. 6.

Figure 8:
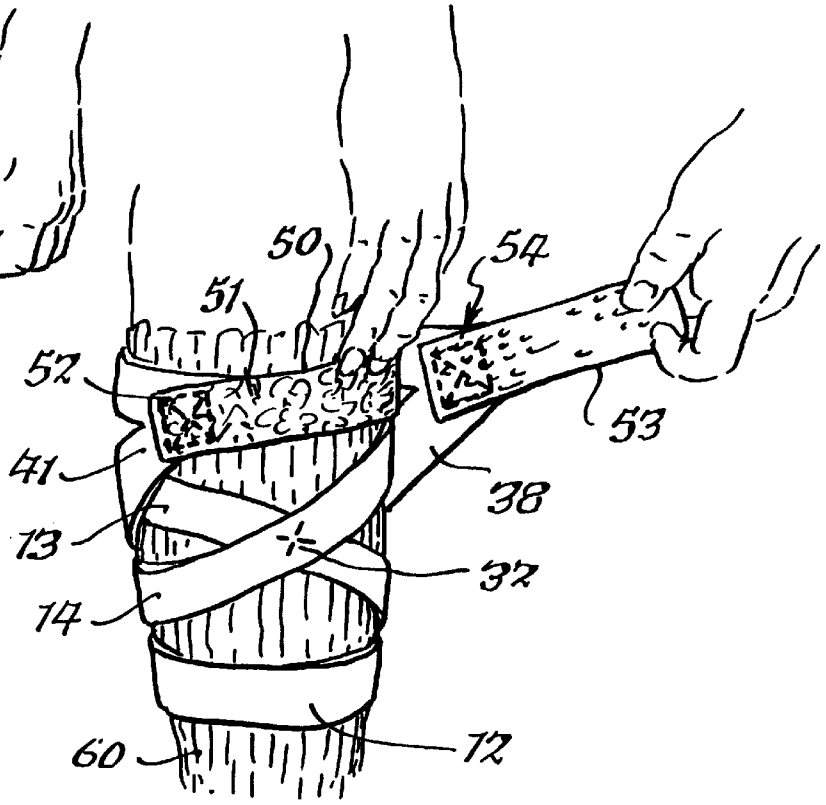
FIG. 8 is a front elevational view illustrating the next step of mounting the fastener on the leg by laying down the attachment member with pile thereon onto the shin.
Figure 9:
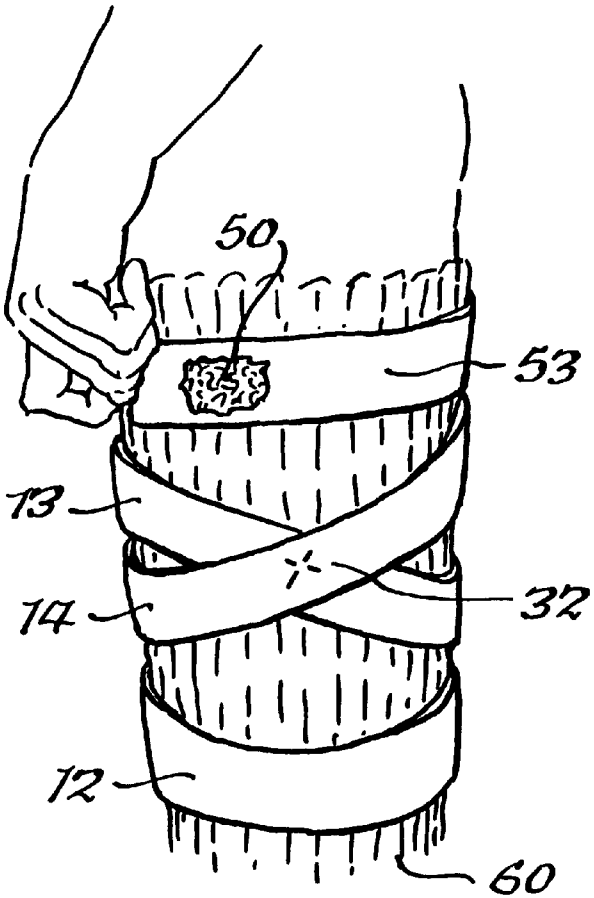
FIG. 9 is a front elevational view showing the attachment member with loops thereon being fastened to the attachment member having pile thereon.

In FIG. 8 the next position is shown wherein the attachment member 50 is laid against the shin with the pile 51 facing away from the shin while the connecting member is held in the position shown. In FIG. 9 the fastening member 53 is fastened to fastening member 50 by engaging the hooks on member 53 with the pile on member 50.

Figure 10:
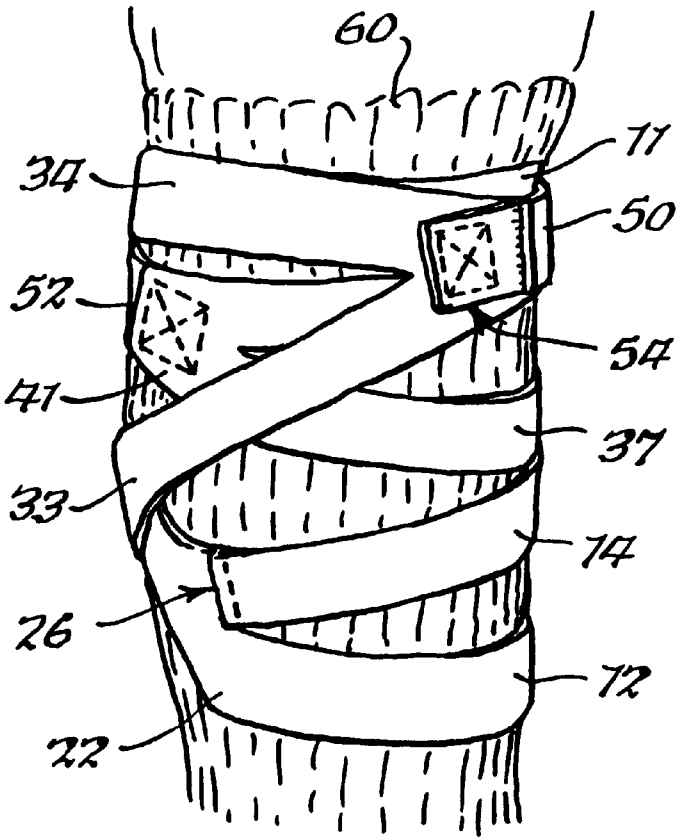
FIG. 10 is a side elevational view of the fully mounted fastener on the right side of the leg.
Figure 12:
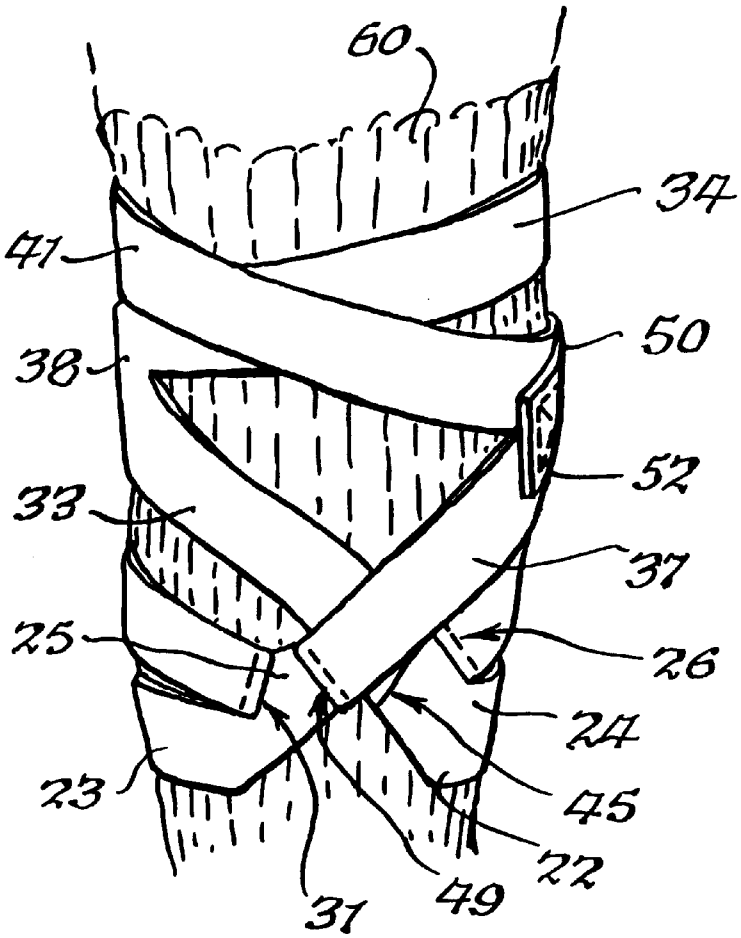
FIG. 12 is a rear elevational view showing the fastener in fully mounted position on the leg.
Figure 11:
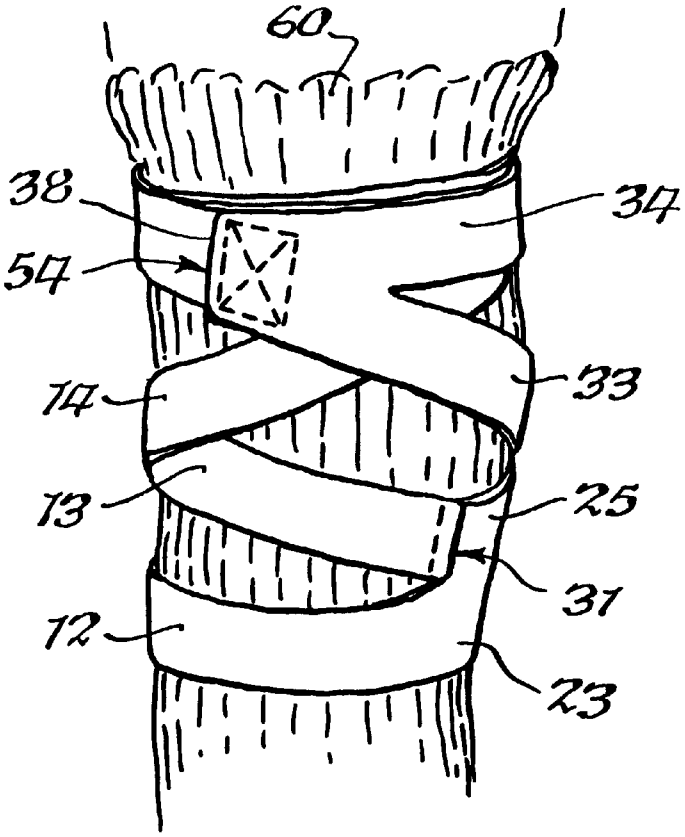
FIG. 11 is a fragmentary side elevational view of the fully mounted fastener on the left side of the leg.

In FIGS. 10, 11 and 12, the positions of the various parts of the fastener 10 are shown when the fastener 10 is in fully installed position on the leg of a person wearing a shin guard.

Figure 13:
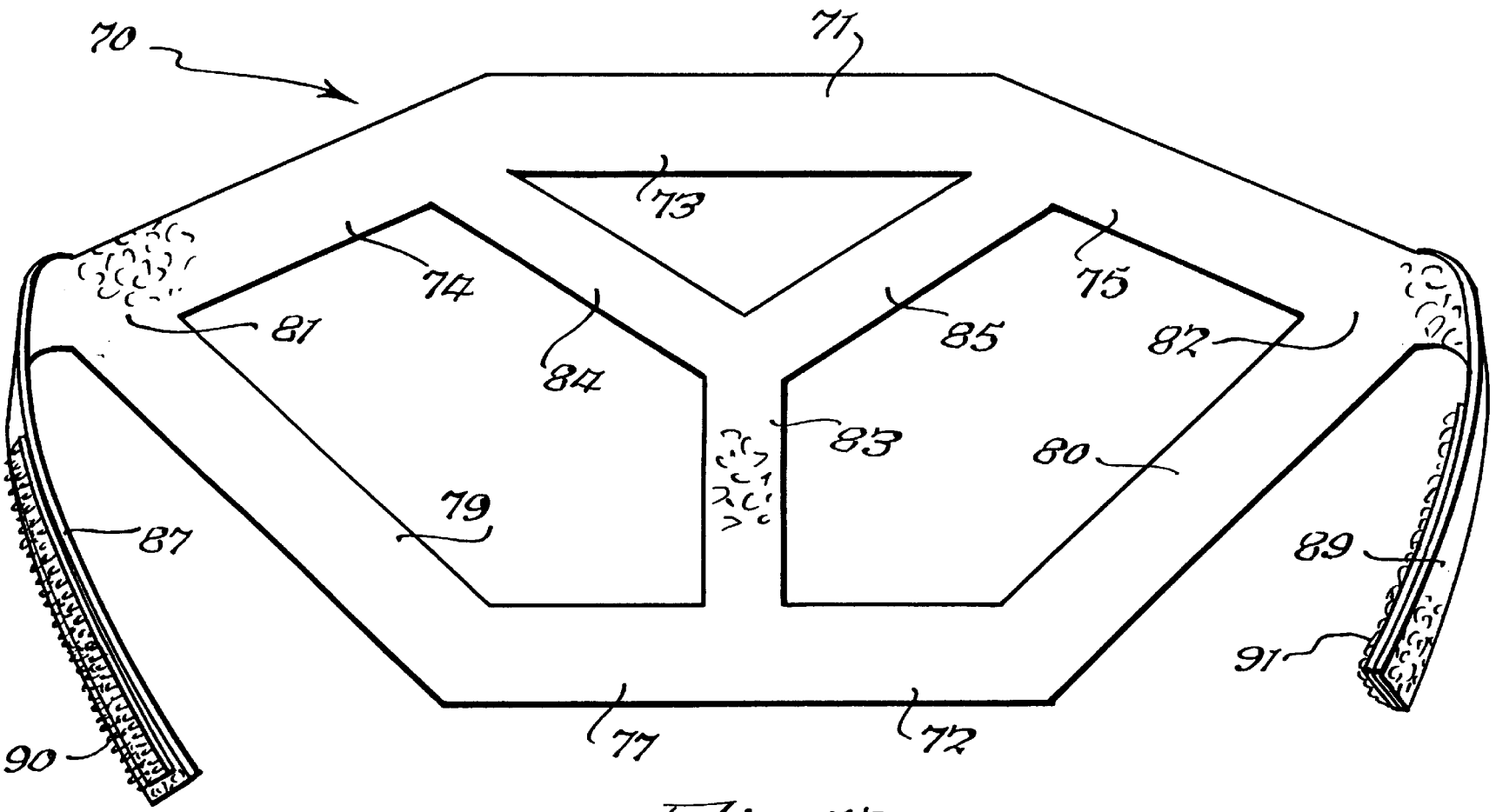
FIG. 13 is a plan view of another fastener embodiment.

In FIG. 13 a shin guard fastener 70 is shown which has a different configuration than the shin guard fastener of FIG. 1. Fastener 70 includes upper band structure 71 and lower band structure 72. Band structure 71 includes an upper band 73 and downwardly extending bands 74 and 75. Lower band structure 72 includes lower band 77 and upwardly extending bands 79 and 80. Bands 73 and 77 are substantially parallel to each other, and lower band 77 is longer than upper band 73. Bands 74 and 79 are joined at vertex 81. Bands 75 and 80 are joined at vertex 82. Band 83 extends upwardly from the central portion of band 77, and bands 84 and 85 extend upwardly and outwardly from the end of band 83 and are connected to the upper band structure 71 proximate the outer ends of upper band 73. Bands 83, 84 and 85 are in a configuration of a Y. Bands 87 and 89 extend outwardly from vertices 81 and 82, respectively. Hook fabric 90 is suitably attached to band 87, and pile fabric 91 is suitably attached to band 89. The various bands of shin guard fastener 70 are fabricated of the same material described above relative to the embodiment of FIG. 1. Also while FIG. 13 does not show how the various bands are attached to each other, it will be appreciated that shin guard fastener 70 may be fabricated by cutting from a single piece of material, or the various bands can be sewn to each other in any suitable manner including the manner discussed above relative to the embodiment of FIG. 1. Alternately, fastener 70 can be made of a combination of bands which are integral with each other and bands which are sewn to each other. The shin guard fastener 70 of FIG. 13 is mounted on the leg of an athlete in the same manner as described above relative to the embodiment of FIG. 1.

The upper band structure 71 and the lower band structure 72 are multiple band structures because they each consist of a plurality of bands. Additionally, the Y-band structure consisting of bands 83, 84 and 85 is also a multiple band structure because it consists of a plurality of bands.

Figure 14:
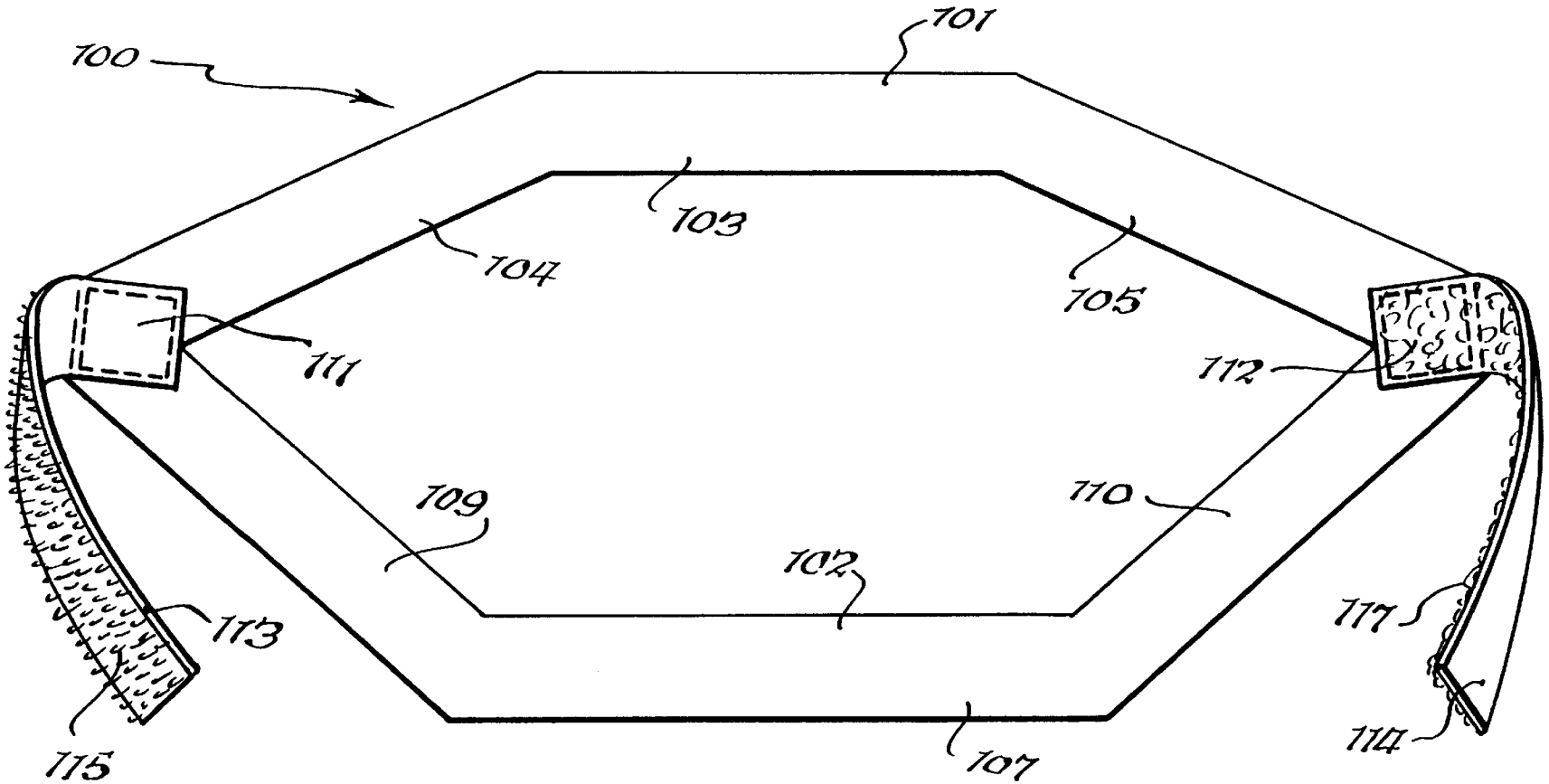
FIG. 14 is a plan view of still another fastener embodiment.

In FIG. 14 a shin guard fastener 100 is shown which has a still different configuration. It includes an upper band structure 101 and a lower band structure 102. The upper band structure 101 includes a band 103, and bands 104 and 105 extend downwardly from upper band 103. The lower band structure 102 includes a lower band 107, and bands 109 and 110 extend upwardly from band 107. Bands 103 and 107 are substantially parallel to each other, and band 107 is longer than band 103. Bands 104 and 109 are joined at vertex 111, and bands 105 and 110 are joined at vertex 112. Band 113 is sewn relative to bands 104 and 109 at vertex 111, and band 114 is sewn relative to bands 105 and 110 at vertex 112. An attachment member in the form of hook fabric 115 extends outwardly from the face of band 113, and an attachment member in the form of pile fabric 117 extends outwardly from the face of band 114. The body of shin guard fastener 100 consisting of the various bands may be cut from a single piece of material, or each of the individual bands may be sewn at their junctures in any suitable manner including those disclosed above relative to FIG. 1, or there can be a combination of integral connections and sewn joints among the various bands. The shin guard fastener is fabricated from the same material set forth above relative to FIG. 1. Also, the shin guard fastener 100 is mounted on the leg of an athlete in substantially the same manner as discussed above relative to the embodiment of FIG. 1.

The upper band structure 101 and the lower band structure 102 are multiple band structures because they consist of a plurality of bands. In the embodiment 100 of FIG. 14 there is no multiple band structure between the upper band structure 101 and the lower band structure 102.

While hook and pile fabrics are the preferred way of attaching the shin guard fasteners to the leg, it will be appreciated that other types of fasteners such as clips, buckles, etc. may be used. Also, while the preferred has been made of bands sewn together, it will be appreciated that the shin guard fastener may be made out of a single piece of material.

While the above description has specifically shown multiple band structures in the form of an X and in the form of a Y between the upper and lower band structures, it will be appreciated that the band structures between the upper band structure and the lower band structure may be in any desired configuration including any combination of one or more horizontal bands, one or more vertical bands, and one or more bands which are inclined to the upper and lower band structures.

Figures 20, 21, 22:
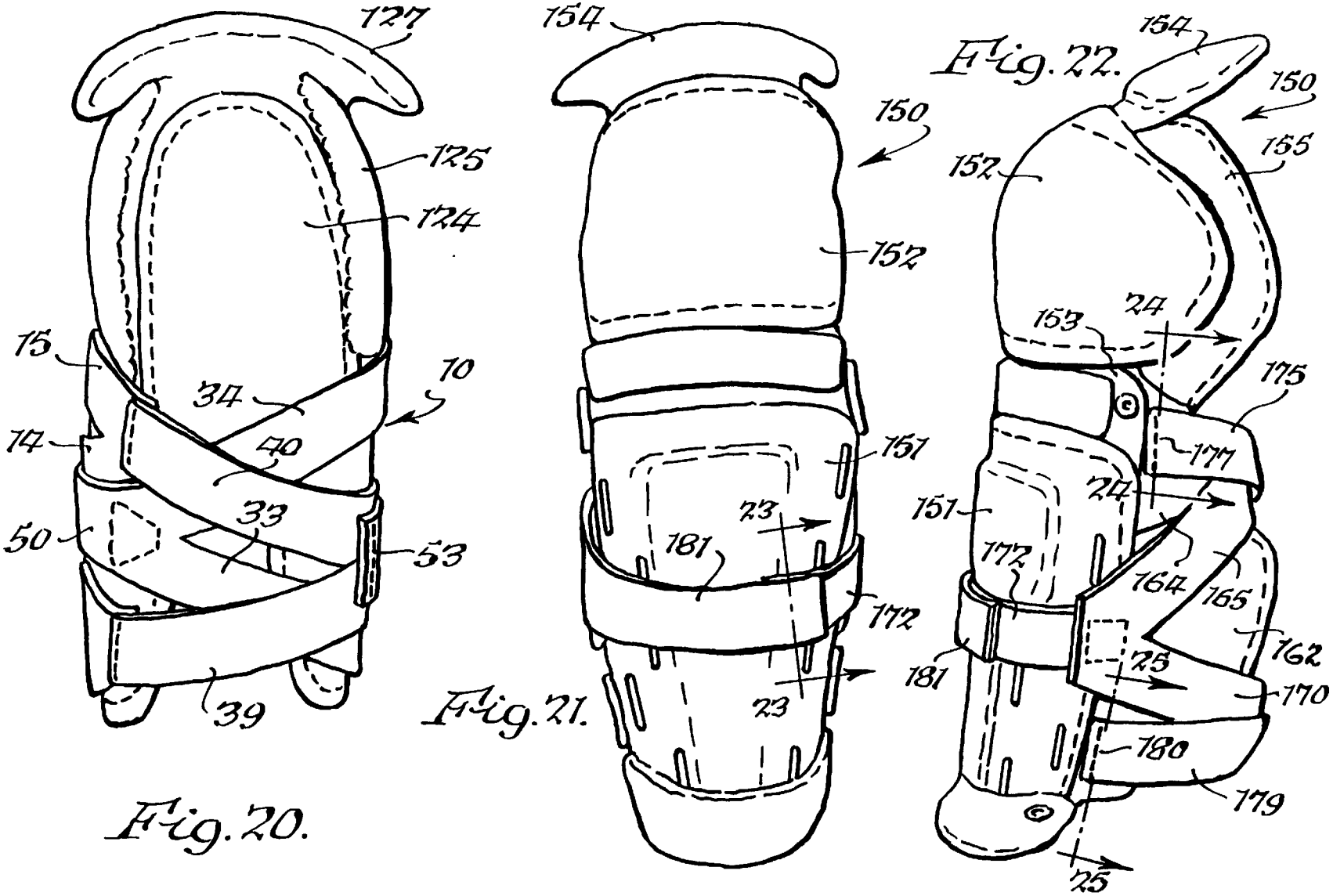
FIG. 20 is a rear elevational view of the combined shin guard and fastener of FIG. 15.
FIG. 21 is a front elevational view of another embodiment of a combined shin guard and fastener in the position which it assumes when mounted on a leg.
FIG. 22 is a side elevational view taken from the right of FIG. 21.
Figure 26:
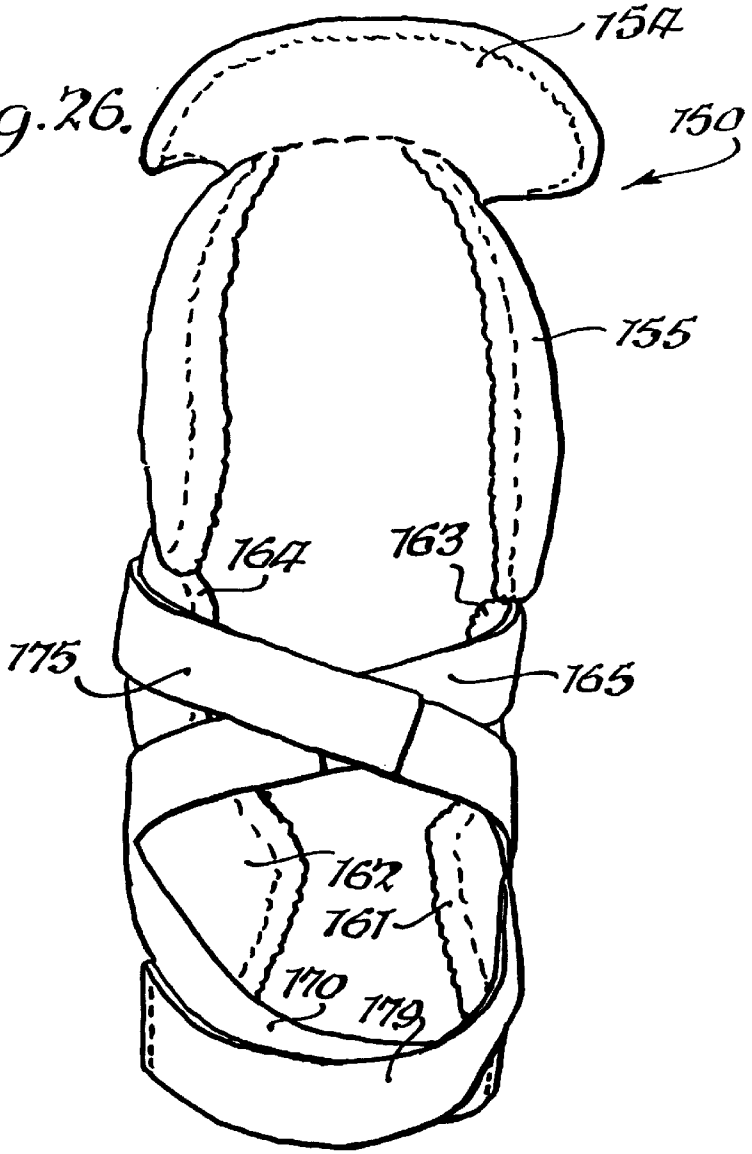
FIG. 26 is a rear elevational view of the combined shin guard and fastener of FIG. 21.
Figure 24:
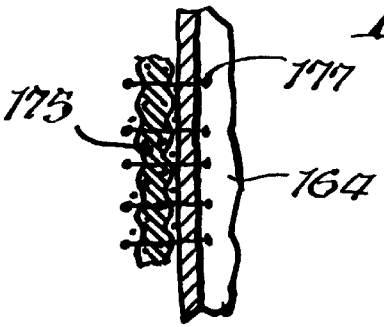
FIG. 24 is a fragmentary cross sectional view taken substantially along line 24—24 of FIG. 22.
Figure 25:
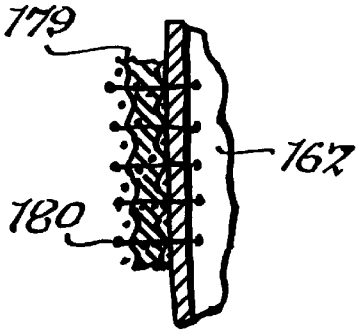
FIG. 25 is a fragmentary cross sectional view taken substantially along line 25—25 of FIG. 22.
Figure 23:
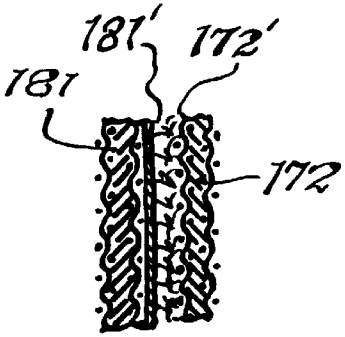
FIG. 23 is a fragmentary cross sectional view taken substantially along line 23—23 of FIG. 21.
Figure 27:
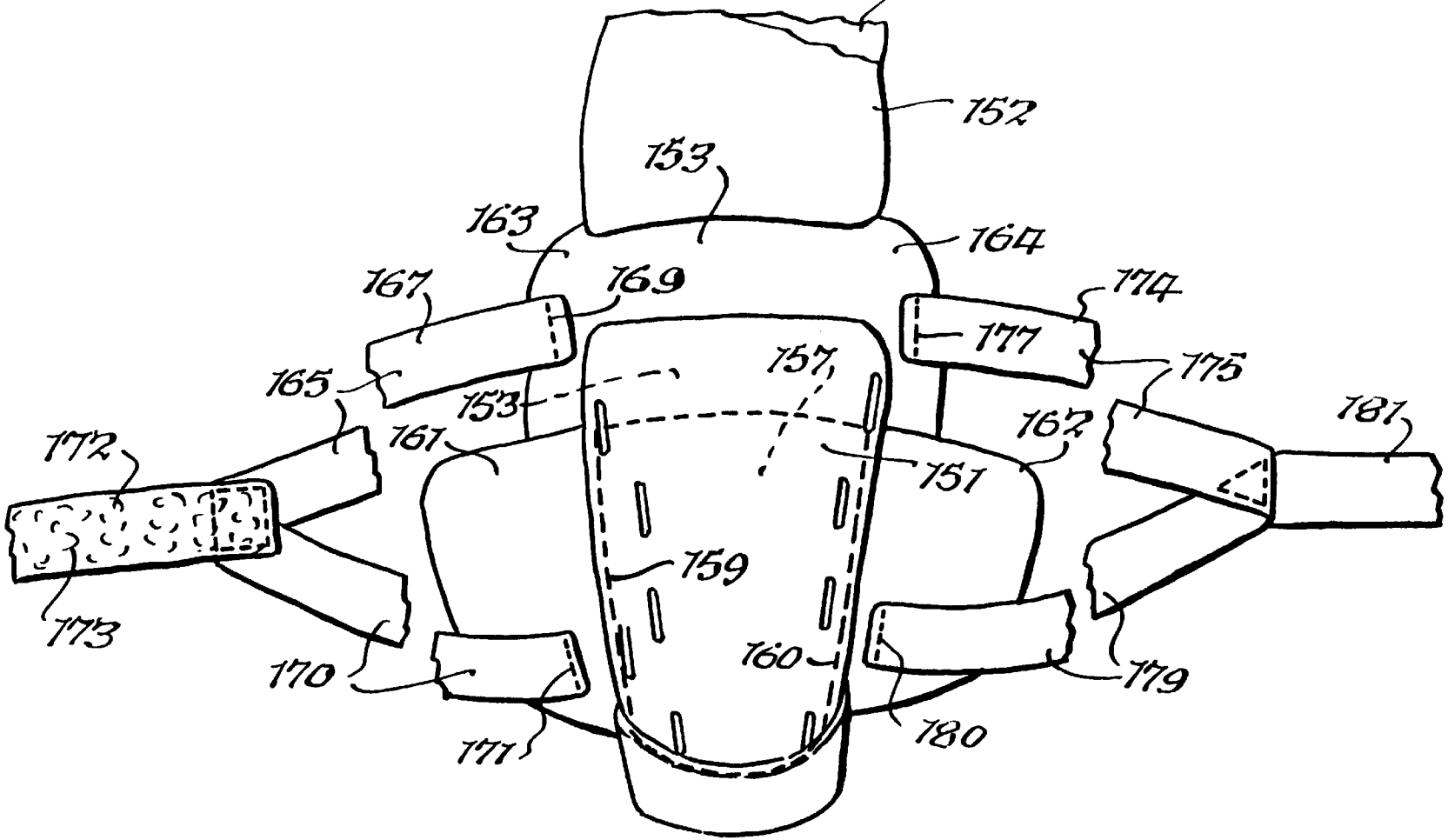
FIG. 27 is a fragmentary front elevational view of the shin guard and fastener of FIG. 21 with the parts spread out.

One embodiment of the improved combined shin guard and fastener is shown in FIGS. 15–20. The combined shin guard and fastener 120 includes a shin guard 121 having a rigid hard plastic shin cover 122 and a rigid hard plastic kneecap cover 123 which are flexibly secured to each other by internal padding 124 (FIG. 20). Also kneecap cover 123 has internal padding 125 and a pad 127 extends upwardly from knee cover 123. Any type of shin guard can be utilized as a part of the present invention provided that it has a shin cover analogous to shin cover 122 which can mount the improved fastener.

The improved fastener itself may be substantially the same as fastener 10 disclosed in FIG. 1, but it need not be limited to the specific forms of stitching disclosed in FIG. 1. Also the fastener itself need only have a plurality of vertically spaced bands which provide longitudinally spaced areas of contact with the leg. Accordingly, identical numerals will be applied to the fastener of FIGS. 15–20 as were applied to the embodiment of FIG. 1, without the need for further description.

In accordance with one aspect of the present invention, hook and pile fastening structure is utilized for the purpose of mounting the fastener 10 to the shin cover 122 of the shin guard. More specifically, a pile patch 129 (FIG. 17) is adhesively secured to the upper portion of shin cover 122 by pressure-sensitive adhesive 130, or any other suitable adhesive. A pile patch 131 (FIG. 18) is adhesively secured to the lower portion of shin cover 122 by adhesive 132. The pile patches may be secured to shin cover 122 in any other suitable manner. The upper central band 15 has a patch 133 with hook fabric suitably permanently attached thereto as by a layer of adhesive 134. Lower central band 16 has a patch of hook fabric 135 permanently secured thereto, as by a layer of adhesive 137. Any other suitable means of attachment for pads 133 and 135, such as sewing, may be used.

The fastener 10 of FIG. 1 may be selectively mounted on shin cover 122 by superimposing pad 133 over pad 129 and by superimposing pad 135 over pad 131 and pressing the pads together. This will mount the fastener 10 of FIG. 1 onto shin cover 122.

Figures 15, 16, 17, 18, 19:
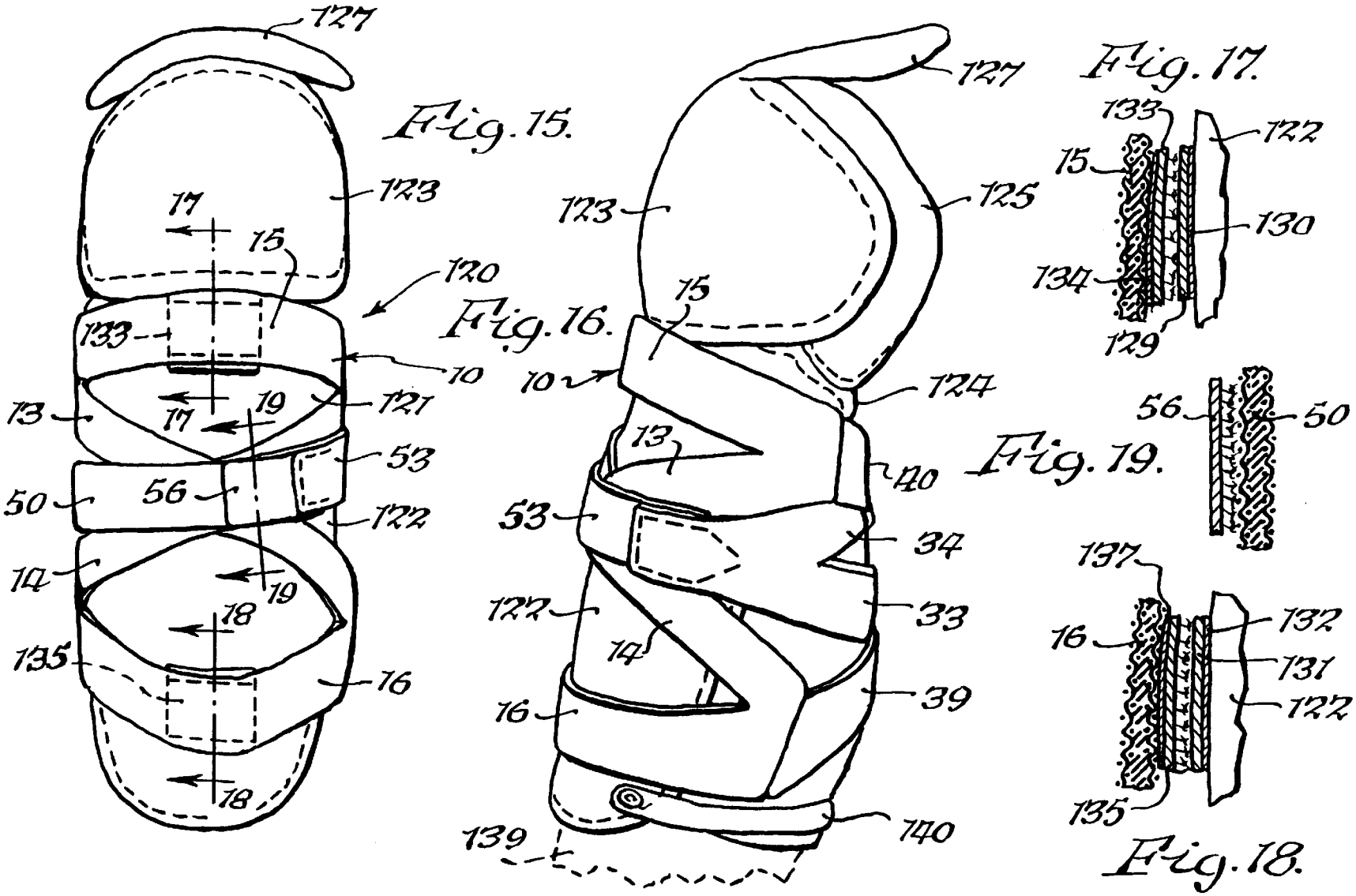
FIG. 15 is a front elevational view of the combined shin guard and fastener of the present invention in the position which it assumes when mounted on a leg.
FIG. 16 is a side elevational view taken from the right of FIG. 15.
FIG. 17 is a fragmentary cross sectional view taken substantially along line 17—17 of FIG. 15.
FIG. 18 is a fragmentary cross sectional view taken substantially along line 18—18 of FIG. 15.
FIG. 19 is a fragmentary cross sectional view taken substantially along line 19—19 of FIG. 15.

In FIG. 16 a leg 139 of an athlete is shown with the shin guard 120 mounted thereon, the leg 139 being omitted from FIGS. 15 and 20, in the interest of clarity. The shin guard and fastener combination 120 is mounted in the manner described above relative to FIGS. 5–12 and the tightness is adjusted by the athlete. Attachment band 50 having the pile fabric thereon and attachment band 53 having the hook fabric thereon are pulled to tighten the remaining portions of the fastener about the rear of the leg. Thereafter, attachment bands 50 and 53 are located in overlying relationship to shin cover 122. and they are connected to each other by the hook and pile fabric. In the embodiments of FIGS. 15–20, the athlete's sock is mounted over the combined shin guard and fastener. As can be seen, the hook fabrics 133 and 135 are narrower than the bands 15 and 16, respectively, on which they are mounted so that there is no possibility that it will catch on the socks which are worn over the fastener 10.

The pile pads 129 and 131 may be sold with the shin guard 121, without the fastener 10, so that the fastener 10 can be purchased as an option. In this regard, the shin guard 121 can be mounted on the leg 139 in the conventional manner by the use of upper and lower straps which are secured to shin cover 122. In this regard, a lower strap 140 is fragmentarily shown in FIG. 16, and it extends between the opposite sides of shin cover 122. One end of the strap is permanently affixed to the shin cover and the opposite end (not shown) is received in a suitable buckle (not shown). An upper band (not shown) which is analogous to lower band 140 is mounted between the opposite sides of shin cover 122. Thus, the shin guard can be sold in the conventional manner with the normal straps such as 140 and its related upper strap and with the patches of pile fabric mounted centrally on the shin cover 122, as shown. The fact that pile fabric is mounted on the shin cover will not interfere with the sock which is mounted over it.

In addition to the foregoing, the fastener 10 may be permanently affixed to the body 122 in any suitable manner, the attachment being at the location of pads 129 and 131, or on any other suitable parts of shin cover 122, or the upper and lower bands 15 and 16, may be secured to shin cover 122 throughout their complete areas of contact.

It will be appreciated that the fastener 70 of FIG. 13 and the fastener 100 of FIG. 14 can be mounted on the shin cover 122 of shin guard 121 in a similar manner to that described above relative to fastener 10 by applying hook fabric to the upper and lower bands. More specifically, patches of hook fabric can be applied to the central portions of upper band 73 and lower band 77 of fastener 70 of FIG. 13. Also patches of hook fabric can be applied to upper band 103 and lower band 107 of fastener 100 of FIG. 14. The patches of hook fabric would be analogous to patches 133 and 135 of FIGS. 17 and 18, respectively. The upper and lower bands of fasteners 70 and 100 may be secured to shin cover 122 in any suitable manner, either permanently or detachably. Also the securement can be along the entire contacting areas of the upper and lower bands with the shin cover 122.

In FIGS. 21–27 another embodiment of the present invention is disclosed wherein the fastener is a permanent part of the shin guard 150. Insofar as pertinent here, the shin guard has a rigid hard plastic shin cover 151 and a rigid hard plastic kneecap cover 152 flexibly attached thereto by a flexible pad 153 which extends along the insides of shin cover 151 and knee cover 152. A pad 154 extends upwardly out of knee cover 152 and a flexible pad 155 extends outwardly from the inner portion of knee cover 152. In addition, a pad 157 (FIG. 27) lines shin cover 151, and it is sewn thereto by stitching 159 and 160 at opposite side edges of shin cover 151. Pad 157 has wing extensions 161 and 162 which extend outwardly beyond the side edges of the lower portion of shin cover 151. In addition, the flexible pad 153 which joins shin cover 151 and kneecap 152 has wings 163 and 164 extending outwardly therefrom proximate the upper portion of shin cover 151. A V-shaped strap assembly 165 has an upper band 167 stitched at 169 to wing 163 and a lower band 170 stitched to wing 161 at 171. The V-shaped band assembly 165 has an attachment band 172 having pile fabric 173 thereon. A band assembly 174 has an upper band 175 stitched to wing 164 at 177, and it has a lower band 179 stitched to wing 162 at 180. An attachment band 181 having hook fabric on its side facing into the drawing is sewn to band assembly 174.

In use, the shin cover 151 of the shin guard 150 is placed against the shin and the strap assemblies 167 and 174 are wound around the calf with one of the assemblies passing through the other. Thereafter the attachment bands 172 and 181 are pulled to the desired tightness. Band 172 is then placed against shin cover 151 and the band 181 is placed over band 172 such that the hook fabric 181' on band 181 engages the pile fabric 172' on band 172 (FIG. 23), the foregoing being depicted in FIGS. 21, 22 and 26.

While the embodiment of FIGS. 15–20 disclosed the use of hook and pile fabric to selectively secure the fastener to the shin cover, it will be appreciated that other types of attachment devices may be used which include, but are not limited to, buttons, snaps and hooks. Also, while hook and pile fabric has been disclosed for fastening the bands 50 and 53 of FIGS. 15–20 to each other and for fastening bands 172 and 181 to each other, it will be appreciated that any other types of fastening arrangements may be employed including but not limited to buckles and snaps.

It can be seen that in the embodiments of FIGS. 15–27 the bands provide a plurality of inclined areas of engagement with the leg of the wearer to thereby firmly hold the shin guard in position, and that the securement of the shin guards is effected by merely connecting two bands to each other on the front of the shin cover.

Figure 28:
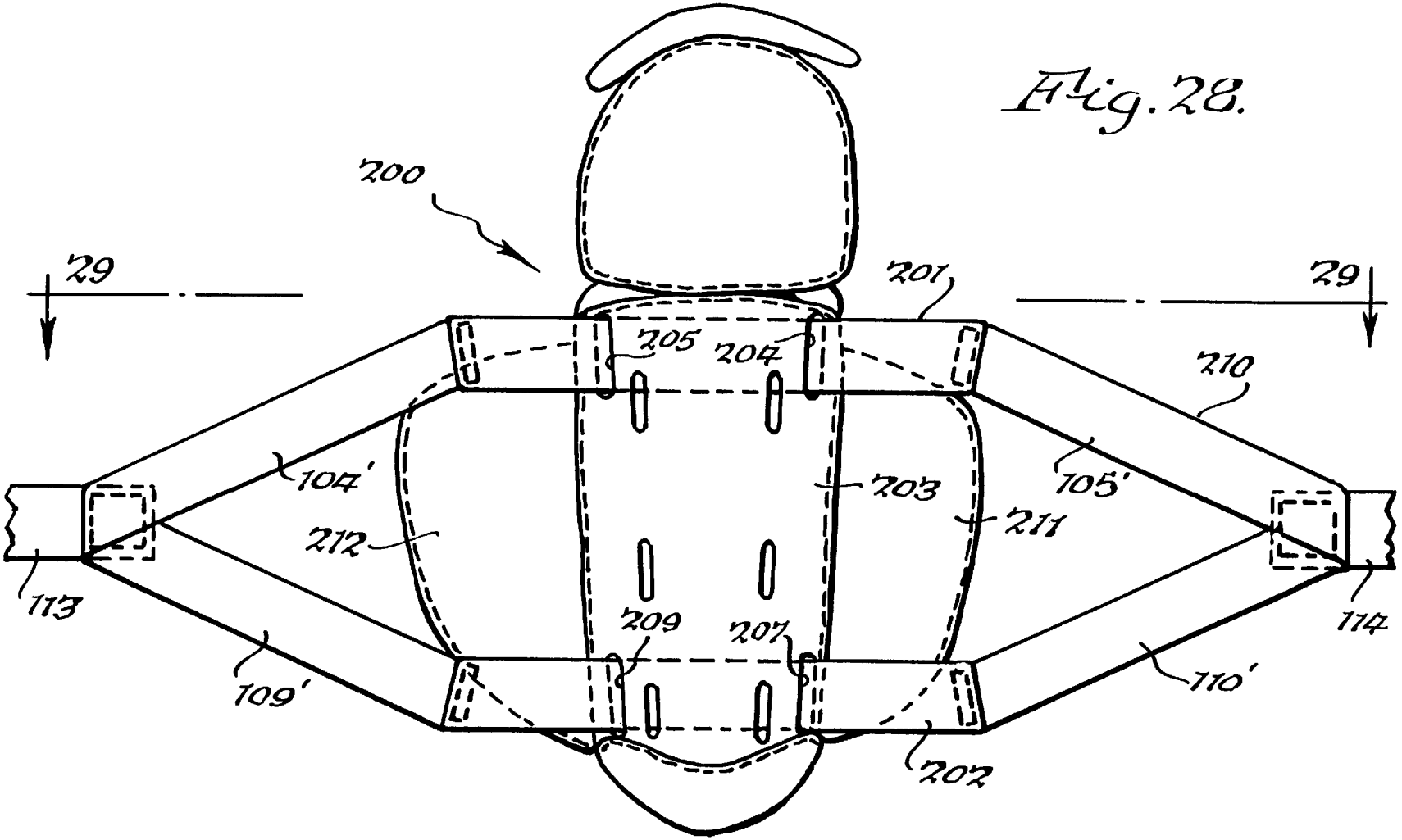
FIG. 28 is a front elevational view of still another embodiment of a combined shin guard and fastener.
Figure 29:
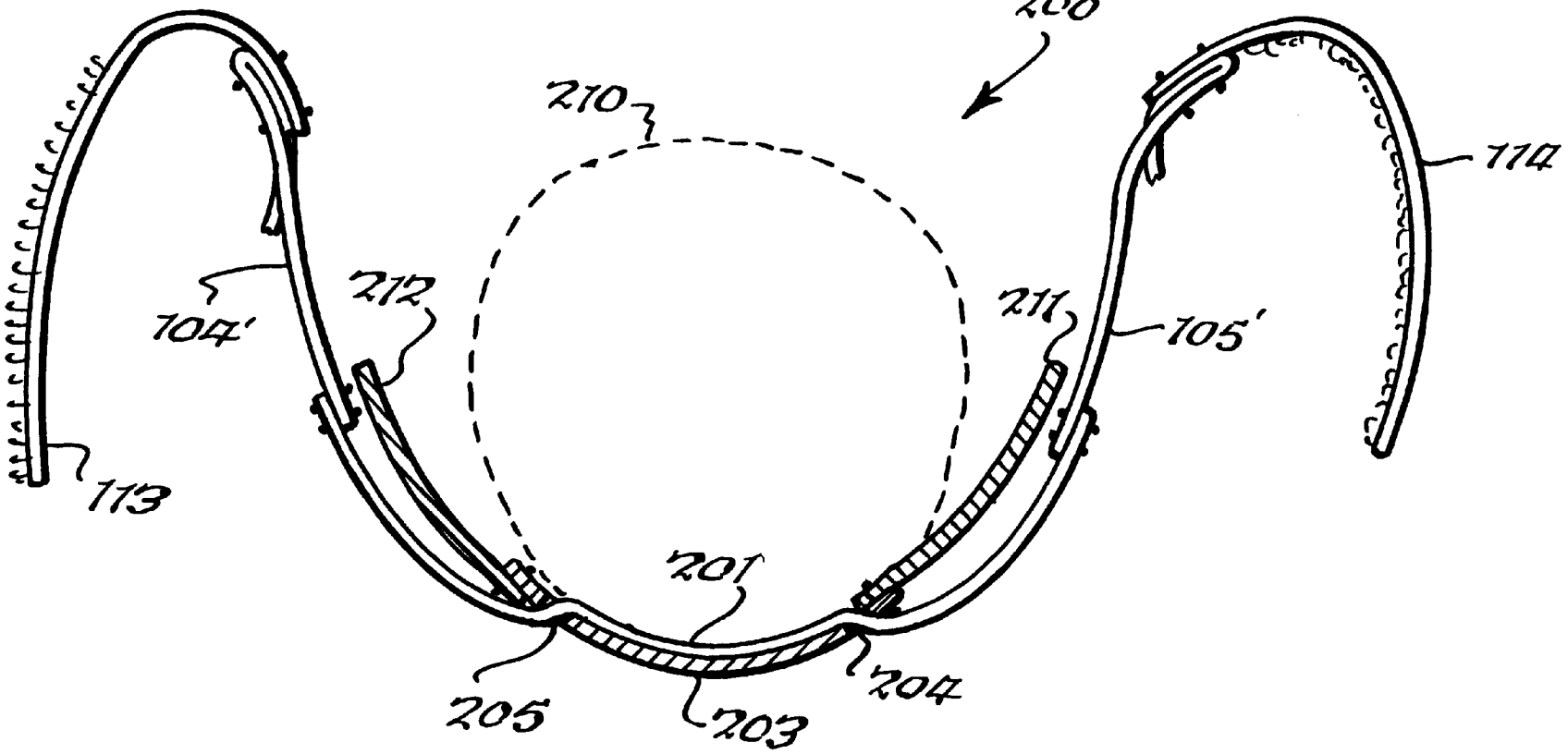
FIG. 29 is a cross sectional view taken substantially along line 29—29 of FIG. 28 but showing various bands extending rearwardly.
Figures 30, 31, 32, 33, 34, 35, 36, 37:
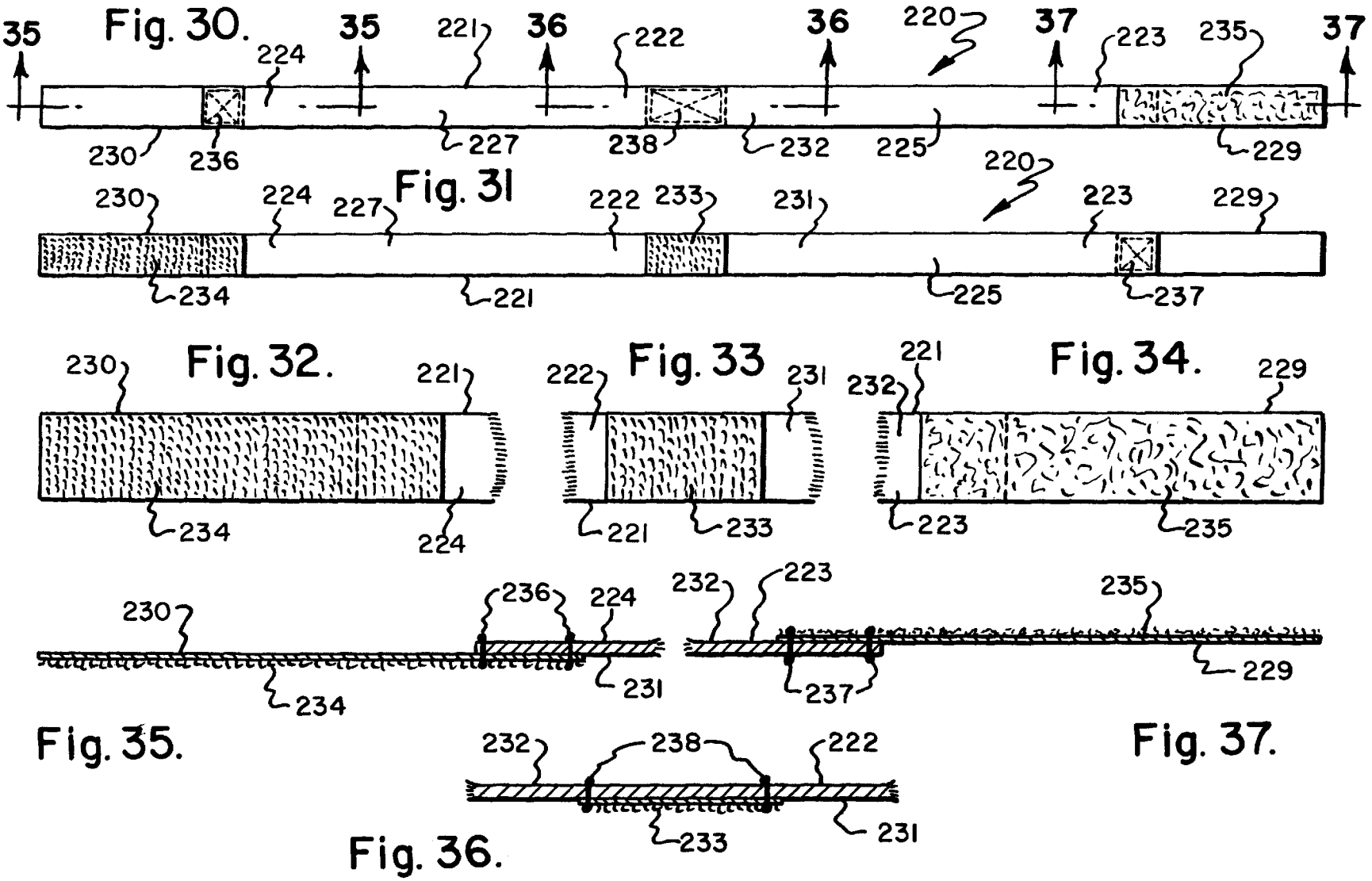
FIG. 30 is a plan view of one side of another embodiment of an improved shin guard fastener.
FIG. 31 is a plan view of the opposite side of the shin guard fastener of FIG. 30.
FIG. 32 is a fragmentary enlarged view of the left end portion of FIG. 31.
FIG. 33 is a fragmentary enlarged view of the central portion of FIG. 31.
FIG. 34 is a fragmentary enlarged view of the right end portion of FIG. 30.
FIG. 35 is an enlarged fragmentary cross sectional view taken substantially along line 35—35 of FIG. 30.
FIG. 36 is an enlarged fragmentary cross sectional view taken substantially along line 36—36 of FIG. 30.
FIG. 37 is an enlarged fragmentary cross sectional view taken substantially along line 37—37 of FIG. 30.

In FIGS. 28 and 29 a modified combined shin guard and fastener 200 is shown. In this embodiment bands 201 and 202 are threaded through hard plastic shin cover 203. More specifically there are slots 204 and 205 in the upper portion of shin cover 203 through which band 201 passes. Also there are slots 207 and 209 through which lower band 202 passes. The fastener 210, of which bands 201 and 202 are a part, can be generally similar to the type of fastener shown in FIG. 14, the only difference being that bands 105' and 110', which correspond to bands 105 and 110, respectively, of FIG. 14 are sewn to bands 201 and 202, respectively, rather than being integral therewith. Likewise, bands 104' and 109' which correspond to bands 104 and 109, respectively, of FIG. 14, are sewn to bands 201 and 202, respectively, rather than being integral with the corresponding bands of FIG. 14. Additionally, bands 113 and 114 may be identical to bands 113 and 114, respectively, of FIG. 14.

In FIG. 29 the combined shin guard and fastener is shown in the process of being mounted about the shin 210 of an athlete with the padded wings 211 and 212 being flexed rearwardly from their positions shown in FIG. 28. When the combined shin guard and fastener 200 is fully mounted on the leg 210, bands 201 and 202 will bear, at least partially, on padded wings 211 and 212, respectively.

It will be appreciated that the combined shin guard and fastener 200 of FIGS. 28 and 29 will be secured to the leg in the same manner described above relative to FIGS. 21 and 22.

In FIGS. 30–37 an additional embodiment of a shin guard fastener is disclosed; and in FIGS. 38–47 there is a showing of the manner in which the improved shin guard fastener of FIGS. 30–37 is placed in combination with a sock which overlies a shin guard; and in FIG. 48 there is a showing how the improved shin guard fastener of FIGS. 30–37 can be combined with an actual shin guard.

The shin guard fastener 220 of FIGS. 30–37 is an elongated band 221 of flexible resilient material which is approximately 63 inches long and 1½ inches wide and approximately ⅛ of one inch thick. This material consists of an elastic neoprene foam core bounded by knit fabric sides and it is product 6122 of the Griswold Rubber Co. It will be appreciated that any other suitable type of elastic band may be used. Elongated band 221 has a central portion 222, outer end portions 223 and 224 and intermediate portions 225 and 227 which are located between the central portion 222 and the outer end portions 223 and 224, respectively. The end portions 223 and 224 include attachment members 229 and 230, respectively.

The shin guard fastener 220 includes a side 231 which faces a sock or shin guard onto which it is to be mounted, and it includes a side 232 which faces away from a shin guard or sock on which it is to be mounted. A swatch of hook fabric 233 is sewn at 238 onto central portion 221. A length of hook fabric 234 is sewn at 236 and forms part of end portion 224. A length of pile fabric 235 is sewn at 237 and forms part of the end portion 223 of the shin guard fastener 220.

The manner in which the improved shin guard fastener 220 is mounted on a leg is shown in FIGS. 38–48. In this respect it can be mounted on the outside of a sock 240 (FIGS. 38–47) which overlies a shin guard 241, which may be of any conventional construction including the constructions shown in the preceding figures but which do not have any of the other shin guard fasteners of the present invention mounted thereon. The improved shin guard fastener 220 is also shown in FIG. 48 wherein it can be mounted directly to a shin guard 241 which underlies a sock.

The first step in mounting the shin guard fastener 220 onto the sock of FIGS. 38–47 is to press the hook fastener swatch 233 on central portion 221 against the sock 240, and this will cause adherence therebetween because the hook fabric fastener 233 will hook into the lower portion of the sock, as shown. The pressing can be effected by holding the fastener 220 with the hands 242 and 243 as shown or the swatch 233 can be digitally pressed against the sock.

The next step is to bring the end portion 223 from the right side of FIG. 38 to the left side of FIG. 39 by winding the band around the rear of the sock and to bring the end portion 224 from the left side of FIG. 38 to the right side of FIG. 39 by winding the band around the rear of the sock, while at the same time causing those portions of the band to extend diagonally upward across the rear of the sock, as shown in FIG. 45, to create the cross over 242.

The next step is shown in FIG. 40 wherein the end portion 223 is brought to the position of FIG. 40 from its position of FIG. 39 and the end portion 224 is brought to the position of FIG. 40 from its position shown in FIG. 39 while at the same time creating a diagonally extending cross over 243 on the front of the sock 240.

The next step is to bring the end portions 223 and 224 to the positions shown in FIG. 41 from the positions shown in FIG. 40 while providing a cross over 244 (FIG. 45) on the rear of the sock, with the cross over showing the band portions extending diagonally upward along sock 240.

The next step is shown in FIG. 42 wherein the end portion 223 is laid across the sock 240 with the pile fabric 235 facing away from the sock, and thereafter pressing the hook attachment 234 on end portion 224 against the pile 235 on end portion 223, as shown in FIG. 43.

During the foregoing steps, the flexible resilient elongated band 221 is tensioned to the desired degree to firmly press the shin guard 241 against the leg 226 without tightening the elongated band to the extent that it cuts off circulation. In this respect, it can hardly cut off circulation under most circumstances because it is flexible and resilient so that it essentially holds the shin guard 241 firmly against the leg, and it can expand and contract as the muscles in the leg expand and contract during the movement of the leg. Additionally, as stated previously relative to the improved fasteners shown relative to FIGS. 1–29, the fastener 220 of FIGS. 30–37 provides a plurality of vertically spaced areas of contact with the leg and the shin guard, which aids in preventing undesired movement of the shin guard. The plurality of vertically spaced areas of contact with the leg can readily be visualized from FIG. 45 wherein the cross overs 242 and 244 press against the calf of the leg. Also, there are a plurality of vertically spaced contact areas with the front of the shin guard, as can be visually from FIG. 44. The plurality of vertically spaced band portions, as shown in FIGS. 44–47, flex and expand and contract because of their flexibility and resilience to thus maintain firm contact between the shin guard and the leg.

In FIGS. 38–47, the shin guard fastener 220 was described in combination with a sock, and in FIGS. 30–37, the shin guard fastener 220 was described as an entity by itself. In FIG. 48 it is shown how the shin guard fastener 220 can be placed in combination with a shin guard 241 by adhesively securing a swatch 245 of pile fabric to the lower central portion of the shin cover 246 of shin guard 241 and thereafter securing the hook fabric 233 on the central portion 221 of the shin guard fastener 220 to pile fabric 245. Thereafter, the shin guard fastener 220 is wound around the shin guard 241 and the leg on which it is mounted in the same manner described above relative to FIGS. 38–47.

The shin guard fastener 220 can be wound around the leg with side 231 thereof facing the leg, as described above relative to FIGS. 38–47 because the hook fabric 233 and 234 is on side 231 of the shin guard fastener, and the pile fabric 229 is on side 232. However, it is conceivable that if a person is willing to twist the band during the process of mounting it to obtain the configurations shown above, the pile fabric and hook fabric may be placed on the same side of the band.

In an actual model which was made having the above-noted overall length of 63 inches and a width of 1½ inches, the hook fabric 234 and the pile fabric 235 were each eight inches long, and the hook fabric 233 was three inches long.

Also, as noted above, relative to the other embodiments of the present invention, while hook and pile fabric are the preferred attachment members, it will be appreciated that the attachment between the central portion of the shin guard fastener and the shin guard may be by any types of snaps or hooks or separable pressure-sensitive adhesives, and the attachment members on the outer ends of the elongated band may be of any desirable types, such as buckles or buttons or snap fasteners or hook and eyelet fasteners, or any other type of suitable fasteners. Also, while a hook attachment 233 has been shown between the band and the sock, it will be appreciated that other types of attachments, such as pins, may be used.

While the elongated band 221 of FIGS. 30–37 is shown as being straight, it will be appreciated that it can be slightly curved if desired.

While preferred embodiments of the present invention have been disclosed, it will be appreciated that it is not limited thereto but may be otherwise embodied within the scope of the following claims.

SEQUENCE LISTING

Not Applicable

What is claimed is:

1. A shin guard fastener and shin guard combination comprising a shin guard, an elongated band having a central portion and outer end portions and intermediate portions between said central portion and said outer end portions, said central portion lying across said shin guard, said intermediate portions extending diagonally relative to said shin guard, and first and second attachment members on said outer end portions.

2. A shin guard fastener and shin guard combination as set forth in claim 1 wherein said elongated band is flexible and resilient.

3. A shin guard fastener and shin guard combination as set forth in claim 2 wherein said attachment members comprise hook and pile fasteners.

4. A shin guard fastener and shin guard combination as set forth in claim 1 including a third attachment member on said central portion attaching said central portion to said shin guard.

5. A shin guard fastener and shin guard combination comprising a shin guard including a shin cover having sides, and a shin guard fastener comprising first band means extending across said shin cover, second band means extending outwardly beyond said sides of said shin cover, and attachment means on said shin guard fastener for securing said shin guard in position.

6. A shin guard fastener and shin guard combination as set forth in claim 5 wherein said first means extend diagonally across said shin cover.

7. A shin guard fastener and shin guard combination as set forth in claim 6 wherein said second means extend diagonally relative to said shin cover.

* * * * *

UNITED STATES PATENT AND TRADEMARK OFFICE

CERTIFICATE OF CORRECTION

PATENT NO. : 6,226,796 B1
DATED : May 8, 2001
INVENTOR(S) : Michael D. Tollini

It is certified that error appears in the above-identified patent and that said Letters Patent is hereby corrected as shown below:

Column 12,
Line 44, (claim 6), after "first" insert -- band --.
Line 47, (claim 7), after "second" insert -- band --.

Signed and Sealed this

Twenty-seventh day of November, 2001

*Attest:*

Nicholas P. Godici

NICHOLAS P. GODICI
*Acting Director of the United States Patent and Trademark Office*

*Attesting Officer*